US007850024B2

(12) United States Patent
Schneider et al.

(10) Patent No.: US 7,850,024 B2
(45) Date of Patent: Dec. 14, 2010

(54) CONTROL SYSTEM FOR A BOOM CRANE

(75) Inventors: Klaus Schneider, Hergatz (DE); Oliver Sawodny, Stuttgart (DE); Joerg Neupert, Korntal-Muenchingen (DE)

(73) Assignee: Liebherr-Werk Nenzing GmbH, Nenzing (AU)

( * ) Notice: Subject to any disclaimer, the term of this patent is extended or adjusted under 35 U.S.C. 154(b) by 177 days.

(21) Appl. No.: 11/974,733

(22) Filed: Oct. 16, 2007

(65) Prior Publication Data

US 2008/0156761 A1 Jul. 3, 2008

(30) Foreign Application Priority Data

Oct. 17, 2006 (DE) ..... 10 2006 048988

(51) Int. Cl.
*B66C 13/06* (2006.01)

(52) U.S. Cl. ..... 212/273; 700/213

(58) Field of Classification Search ..... 212/273; 700/213

See application file for complete search history.

(56) References Cited

U.S. PATENT DOCUMENTS

| | | | | |
|---|---|---|---|---|
| 5,908,122 | A | 6/1999 | Robinett et al. | |
| 6,442,439 | B1 * | 8/2002 | Robinett et al. | 700/55 |
| 6,496,765 | B1 * | 12/2002 | Robinett et al. | 701/50 |
| 6,631,300 | B1 * | 10/2003 | Nayfeh et al. | 700/55 |
| 2004/0164041 | A1 | 8/2004 | Sawodny et al. | |

FOREIGN PATENT DOCUMENTS

| | | |
|---|---|---|
| DE | 4025749 | 2/1992 |
| DE | 10064182 | 5/2002 |
| DE | 10324692 | 1/2005 |
| EP | 1 314 681 A1 * | 5/2003 |

OTHER PUBLICATIONS

Command Shaping and Closed-Loop Control Interactions for a Ship Crane, by Michael Agostinin et al, for the Proceedings of the American Control Conference, Anchorage, AK, May 8-18, 2002.*
Experimental Verification of Command Shaping Boom Crane Control System, by Gordan Parker et al, for the Proceedings of the American Control Conference, San Diego CA, Jun. 1999.*
Konstruktion/Wissenschaft/Forschung Dec. 1991, pp. 43-47.
EPO Search Report for Appln. EP 07019661.

* cited by examiner

*Primary Examiner*—Thomas J Brahan
(74) *Attorney, Agent, or Firm*—Dilworth & Barrese, LLP

(57) ABSTRACT

A control system for a boom crane, having a tower and a boom pivotally attached to the tower, a first actuator for creating a luffing movement of the boom, a second actuator for rotating the tower, first means for determining the position $r_A$ and/or velocity $\dot{r}_A$ of the boom head by measurement, second means for determining the rotational angle $\phi_D$ and/or the rotational velocity $\dot{\phi}_D$ of the tower by measurement, the control system controlling the first actuator and the second actuator. In the control system of the present invention the acceleration of the load in the radial direction due to a rotation of the tower is compensated by a luffing movement of the boom in dependence on the rotational velocity $\dot{\phi}_D$ of the tower determined by the second means. The present invention further comprises a boom crane having such a system.

27 Claims, 14 Drawing Sheets

CONTROL SYSTEM FOR A BOOM CRANE

BACKGROUND OF THE INVENTION

The present invention relates to a control system for a boom crane, wherein the boom crane has a tower and a boom pivotally attached to the tower, a first actuator for creating a luffing movement of the boom, and a second actuator for rotating the tower. The crane further has first means for determining the position $r_A$ and/or velocity $\dot{r}_A$ of the boom head by measurement and second means for determining the rotational angle $\phi_D$ and/or the rotational velocity $\dot{\phi}_D$ of the tower by measurement. The control system for the boom crane controls the first actuator and the second actuator of the crane.

Such a system is for example known from DE 100 64 182 A1, the entire content of which is included into the present application by reference. There, a control strategy for controlling the luffing movement of the boom is presented, which tries to avoid swaying of the load based on a physical model of the load suspended on the rope of the crane and the crane itself. The model used is however only linear and therefore does not take into account the important non-linear effects observed in boom cranes. As the centrifugal acceleration of the load due to the rotation of the tower can also lead to swaying of the load, a pre-control unit tries to compensate it using data for the rotation of the crane based on the desired tangential movement of the load given by a reference trajectory generator as an input. However, these data based on the reference trajectories used in the pre-control unit can differ considerably from the actual movements of the crane and therefore lead to an imprecise control of the movements of the load and especially to a poor anti-sway-control.

From DE 103 24 692 A1, the entire content of which is included into the present application by reference, a trajectory planning unit is known which also tries to avoid swaying of the load suspended on a rope. However, the same problems as above occur, as the entire trajectory planner is based on modelled data and therefore again acts as a pre-control system.

SUMMARY OF THE INVENTION

The object of the present invention is therefore to provide a control system for boom crane having better precision and especially leading to better anti-sway-control.

This object is met by a control system for a boom crane described herein. In such a control system controlling the first actuator and second actuator of the boom crane, the acceleration of the load in the radial direction due to a rotation of the tower is compensated by a luffing movement of the boom in dependence on the rotational velocity $\dot{\phi}_D$ of the tower determined by the second means. The second means determines this rotational velocity $\dot{\phi}_D$ of the tower by either directly measuring the velocity or by measuring the position of the tower in relation to time and then calculating the velocity from these data. In the present invention, the control of the luffing movement of the boom compensating the acceleration of the load in the radial direction due to the rotation of the tower is therefore based on measured data, which represent the actual movements of the crane. Thereby, the problems present in pre-control systems are avoided, as the anti-sway-control that also takes into account the rotational movements of the tower is integrated into the control system and based on data obtained by measurements. Thereby, the present invention leads to a high precision anti-sway-control.

Preferably, the control system of the present invention has a first control unit for controlling the first actuator and a second control unit for controlling the second actuator. Such a decentralized control architecture leads to a simple and yet effective control system.

Preferably, the first control unit avoids sway of the load in the radial direction due to the luffing movements of the boom and the rotation of the tower. Thereby, the first control unit controlling the luffing movements of the boom takes into account both the sway created by the luffing movements of the boom themselves and the sway due to the rotation of the tower. This leads to the particular effective anti-sway-control of the present invention.

Preferably, the second control unit avoids sway of the load in the tangential direction due to the rotation of the tower. Thereby, the second control unit automatically avoids sway in the tangential direction and makes the handling of the load easier for the crane driver. However, the second actuator could also be directly controlled by the crane driver without an additional anti-sway-control.

Preferably, in the present invention, the first and/or the second control unit are based on the inversion of nonlinear systems describing the respective crane movements in relation to the sway of the load. As many important contributions to the sway of the load depend on nonlinear effects of the crane, the actuators and the load suspended on the rope, the nonlinear systems of the present invention lead to far better precision than linear systems. These nonlinear systems have the state of the crane as an input, and the position and movements of the load as an output. By inverting these systems, the position and movements of the load can be used as an input to control the actuators moving the crane.

Preferably, in the present invention, the crane additionally has third means for determining the radial rope angle $\phi_{Sr}$ and/or velocity $\dot{\phi}_{Sr}$ and/or the tangential rope angle $\phi_{St}$ and/or velocity $\dot{\phi}_{St}$ by measurement. The rope angles and velocities describe the sway of the load suspended on the rope, such that determining these data by measurement and using them as an input for the control system of the present invention will lead to higher precision.

Preferably, in the present invention, the control of the first actuator by the first control unit is based on the rotational velocity $\dot{\phi}_D$ of the tower determined by the second means. Thereby, the first control unit for controlling the luffing movement of the boom will also take into account the acceleration of the load in the radial direction due to the rotational velocity of the tower. Additionally, such a control will preferably also be based on the radial rope angle $\phi_{Sr}$ and/or velocity $\dot{\phi}_{St}$ obtained by the third means. Preferably, it will also be based on the position $\dot{r}_A$ and/or velocity $\dot{r}_A$ of the boom head obtained by the first means.

Preferably, in the present invention, higher order derivatives of the radial load position $\ddot{r}_{La}$ and preferably $\dddot{r}_{La}$ are calculated from the radial rope angle $\phi_{Sr}$ and velocity $\dot{\phi}_{Sr}$ determined by the third means and the position $r_A$ and velocity $\dot{r}_A$ of the boom head determined by the first means. These higher order derivates of the radial load position are very hard to determine by direct measurement, as noise in the data will lead to poorer and poorer results. However, these data are important for the control of the load position, such that the present invention, where these higher order derivates are calculated from position and velocity measurements by a direct algebraic relation, leads to far better results. Those skilled in the art will readily acknowledge that this feature of the present invention is highly advantageous independently of the other features of the present invention.

Preferably, in the present invention, higher order derivatives of the rotational load angle $\ddot{\phi}_{LD}$ and preferably $\dddot{\varphi}_{LD}$ are calculated from the tangential rope angle $\phi_{St}$ and velocity $\dot{\phi}_{St}$ determined by the third means and the rotational angle $\phi_D$ and the rotational velocity $\dot{\phi}_D$ of the tower determined by the second means. As for the higher order derivates of the radial load position, the higher order derivates of the rotational load angle are important for load position control but hard to obtain from direct measurements. Therefore, this feature of the present invention is highly advantageous, independently of other features of the present invention.

Preferably, in the present invention, the second means additionally determine the second and/or the third derivative of the rotational angle of the tower $\ddot{\phi}_D$ and/or $\dddot{\varphi}_{LD}$. These data can be important for the control of the position of the load and are therefore preferably used as an input for the control system of the present invention.

Preferably, the second and/or third derivative of the rotational angle of the tower $\ddot{\phi}_D$ and/or $\dddot{\varphi}_{LD}$ is used for the compensation of the sway of the load in the radial direction due to a rotation of the tower. Using these additional data on the rotation of the tower will lead to a better compensation of the centrifugal acceleration of the load and therefore to a better anti-sway-control.

The present invention further comprises a control system based on the inversion of a model describing the movements of the load suspended on a rope in dependence on the movements of the crane. This model will preferably be a physical model of the load suspended on a rope and the crane having the movements of the crane as an input and the position and movements of the load as an output. By inverting this model, the position and movements of the load can be used as an input for the control system of the present invention to control the movements of the crane, preferably by controlling the first and second actuators. Such a control system is obviously highly advantageous independently of the features of the control systems described before. However, it is particular effective especially for the anti-sway-control compensating the rotational movements of the tower as described before.

Preferably, the model used for this inversion is non-linear. This will lead to a particularly effective control, as many of the important contributions to the movements of the load are nonlinear effects.

Preferably, in the present invention, the control system uses the inverted model to control the first and second actuators in order to keep the load on a predetermined trajectory. The desired position and velocity of the load given by this predetermined trajectory will be used as an input for the inverted model, which will then control the actuators of the crane accordingly, moving the load on the predetermined trajectory.

Preferably, in the present invention, the predetermined trajectories of the load are provided by a trajectory generator. This trajectory generator will proved the predetermined trajectories, i. e. the paths on which the load should move. The control system will then make sure that the load indeed moves on these trajectories by using them as an input for the inverted model.

Preferably, the model takes into account the non-linearities due to the kinematics of the first actuator and/or the dynamics of the first actuator. Due to the geometric properties of a crane, the movements of the actuators usually do not translate linearly to movements of the crane or the load. As the system of the present invention is preferably used for a boom crane, and the first actuator preferably is the actuator for the radial direction creating a luffing movement of the boom, the actuator will usually be a hydraulic cylinder that is linked to the tower on one end and to the boom on the other end. Therefore the movement of the actuator is in a non-linear relation to the movement of the boom end and therefore to the movement of the load. These nonlinearities will have a strong influence on the sway of the load. Therefore the anti-sway-control unit of the present invention that takes these non-linearities into account will provide far better precision than linear models. The dynamics of the actuator also have a large influence on the sway of the load, such that taking them into account, for example by using a friction term for the cylinder, also leads to better precision. These dynamics also lead to non-linearities, such that an anti-sway control that takes into account the non-linearities due to the dynamics of the first actuator is even superior to one that only takes into account the dynamics of the actuator in a linear model. However, the present invention comprises both these possibilities.

In the present invention, the anti-sway-control is preferably based on a non-linear model of the load suspended on the rope and the crane including the first actuator. This non-linear model allows far better anti-sway-control than a linear model, as most of the important effects are non-linear. Especially important are the non-linear effects of the crane including the first actuator, which cannot be omitted without loosing precision.

Preferably, the non-linear model is linearized either by exact linearization or by input/output linearization. Thereby, the model can be inverted and used for controlling the actuators moving the crane and the load. If the model is exactly linearizable, it can be inverted entirely. Otherwise, only parts of the model can be inverted by input/output linearization, while other parts have to be determined by other means.

Preferably, in the present invention, the non-linear model is simplified to make linearization possible. Thereby, some of the non-linear parts of the model that only play a minor role for the sway of the load but make the model too complicated to be linearized can be omitted. For example, the load suspended on the rope part of the model can be simplified by treating it as an harmonic oszillator. This is a very good approximation of the real situation at least to for small angles of the sway. The non-linear model simplified in this way is then easier to linearize.

Preferably, the internal dynamics of the model due to the simplification are stable and/or measurable. The simplifications that allow the linearization of the model create a difference between the true behaviour of the load and the behaviour modelled by the simplified model. This leads to internal dynamics of the model. At least the zero dynamics of this internal model should be stable for the simplified model to work properly. However, if the internal dynamic is measurable, i.e. that it can be determined by measuring the state of the system and thereby by using external input, unstable internal dynamics can be tolerated.

Preferably, in the present invention, the control is stabilized using a feedback control loop. In the feedback control loop, measured data on the state of the crane or the load are used as an input for the control unit for stabilization. This will lead to a precise control.

Preferably, in the present invention, the sway of the load is compensated by counter-movements of the first actuator. Therefore, if the load would sway away from its planned trajectory, counter-movements of the actuator will counteract this sway and keep the load on its trajectory. This will lead to a precise control with minimal sway.

Preferably, these counter-movements occur mostly at the beginning and the end of a main movement. As the acceleration at the beginning and the end of a main movement will lead to a swaying movement of the load, counter-movements at these points of the movement will be particularly effective.

Preferably, in the present invention, the non-linear model describes the radial movement of the load. As the main effects leading to a sway of the load occur in the radial direction, modelling this movement is of great importance for anti-sway control. For boom cranes, such a model will describe the luffing movements of the boom due to the actuator and the resulting sway of the load in the radial direction.

Preferably, in the present invention, the centrifugal acceleration of the load due to the rotation of the crane is taken into account. When the crane, especially a boom crane, rotates, this rotational movement of the crane will lead to a rotational movement of the load which will cause a centrifugal acceleration of the load. This centrifugal acceleration can lead to swaying of the load. As rotations of the crane will lead to a centrifugal acceleration of the load away from the crane, they can be compensated by a luffing of the boom upwards and inwards, accelerating the load towards the crane. This compensation of the centrifugal acceleration by luffing movements of the boom will keep the load on its trajectory and avoid sway.

Preferably, in the present invention, the centrifugal acceleration is treated as a disturbance, especially a time-varying disturbance. This will lead to a particular simple model, which nevertheless takes into account all the important contributions to the sway of the load. For the main contributions coming from the movement in the radial direction, non-linear effects are taken into account, while the minor contributions of the centrifugal acceleration due to the tangential movement are treated as a time-varying disturbance.

The present invention further comprises a boom crane, having a tower and a boom pivotally attached to the tower, a first actuator for creating a luffing movement of the boom and a second actuator for rotating the tower, first means for determining the position $r_A$ and/or velocity $\dot{r}_A$ of the boom head by measurement and preferably second means for determining the rotational angle $\phi_D$ and/or the rotational velocity $\dot{\phi}_D$ of the tower by measurements, wherein a control system as described above is used. Obviously, such a boom crane will have the same advantages as the control systems described above.

BRIEF DESCRIPTION OF THE DRAWINGS

Embodiments of the present invention will now be described in more detail using drawings.

DESCRIPTION OF THE PREFERRED EMBODIMENTS

In order to handle the increasing amount and variety of cargo which has to be transshipped in harbors, more and more handling equipment such as the LIEBHERR harbor mobile crane (LHM) are used. At this kind of crane, the payload is suspended on a rope, which results in strong load oscillations. Because of safety and performance reasons this load sway should be avoided during and especially at the end of each transfer process. In order to reduce these load sways, it is state of the art to use linear control strategies. However, in the considered case, the dynamics of the boom motion is characterized by some dominant nonlinear effects. The use of a linear controller would therefore cause high trajectory tracking errors and insufficient damping of the load sway. To overcome these problems, the present invention uses a nonlinear control approach, which is based on the inversion of a simplified nonlinear model. This control approach for the luffing movement of a boom crane allows a swing-free load movement in radial direction. Using an additional stabilizing feedback loop the resulting Crane control of the present invention shows high trajectory tracking accuracy and good load sway damping. Measurement results are presented to validate the good performance of the nonlinear trajectory tracking controller.

Boom cranes such as the LIEBHERR harbor mobile crane LHM (see FIG. 1) are used to handle transshipment processes in harbors efficiently. This kind of boom cranes is characterized by a load capacity of up to 140 tons, a maximum outreach of 48 meters and a rope length of up to 80 meters. During transfer process, spherical load oscillation is excited. This load sway has to be avoided because of safety and performance reasons.

Figure 1:
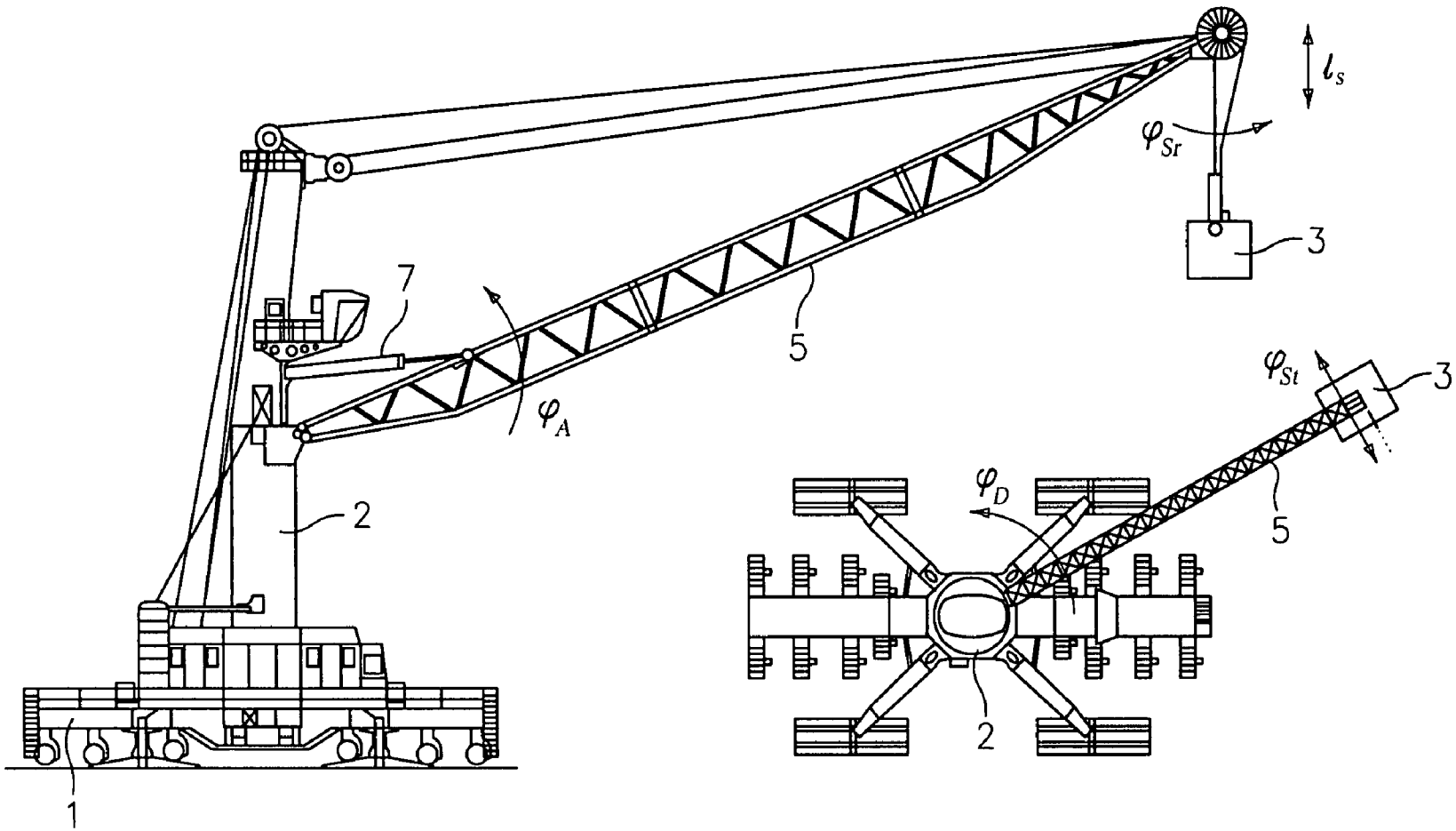
FIG. 1 shows a boom crane.

As shown in FIG. 1, such a harbour mobile boom crane consists of a mobile platform 1, on which a tower 2 is mounted. The tower 2 can be rotated around a vertical axis, its position being described by the angle $\phi_D$. On the tower 2, a boom 5 is pivotally mounted that can be luffed by the actuator 7, its position being described by the angle $\phi_A$. The load 3 is suspended on a rope of length $l_S$ from the head of the boom 5 and can sway with the angle $\phi_{Sr}$.

Generally, cranes are underactuated systems showing oscillatory behavior. That is why a lot of open-loop and closed-loop control solutions have been proposed in the literature. However, these approaches are based on the linearized dynamic model of the crane. Most of these contributions do not consider the actuator dynamics and kinematics. In case of a boom crane, which is driven by hydraulic actuators, the dynamics and kinematics of the hydraulic actuators are not negligible. Especially for the boom actuator (hydraulic cylinder) the kinematics has to be taken into account.

1. First Embodiment

The first embodiment uses a flatness based control approach for the radial direction of a boom crane. The approach is based on a simplified nonlinear model of the crane. Hence the linearizing control law can be formulated. Additionally it is shown that the zero dynamics of the not simplified nonlinear control loop guarantees a sufficient damping property.

1.1. Nonlinear Model of the Crane

Considering the control objectives of rejecting the load sway and tracking a reference trajectory in radial direction, the nonlinear dynamic model has to be derived for the luffing motion. The first part of the model is obtained by neglecting the mass and the elasticity of the rope assuming the load to be a point mass neglecting the centripetal and coriolis terms Utilizing the method of Newton/Euler and considering the given assumptions results in the following differential equation of motion for the load sway in radial direction:

$$\ddot{\varphi}_{Sr} + \frac{g}{l_S}\sin(\varphi_{Sr}) = \frac{\cos(\varphi_{Sr})}{l_S}\ddot{r}_A \tag{1.1}$$

Figure 2:
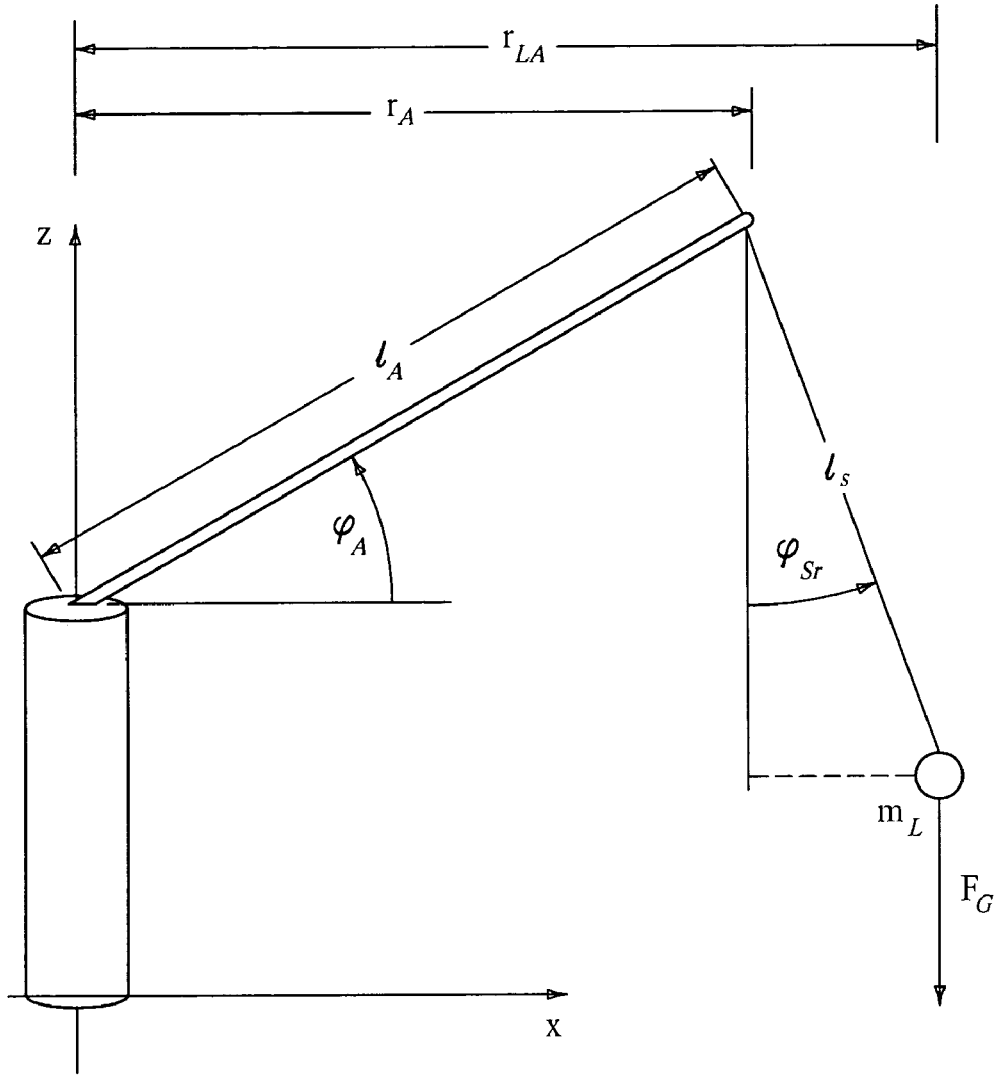
FIG. 2 shows a schematic representation of the luffing movement of such a crane.

FIG. 2 shows a schematic representation of the luffing movement, where $\phi_{Sr}$ is the radial rope angle, $\ddot{\phi}_{Sr}$ the radial angular acceleration, $l_S$ the rope length, $\ddot{r}_A$ the acceleration of the end of the boom and g the gravitational constant.

The second part of the dynamic model describes the kinematics and dynamics of the actuator for the radial direction. Assuming the hydraulic cylinder to have fist order behavior the differential equation of motion is obtained as follows:

$$\ddot{z}_{zyl} = -\frac{1}{T_W}\dot{z}_{zyl} + \frac{K_{VW}}{T_W A_{zyl}}u_l \tag{1.2}$$

Where $\ddot{z}_{zyl}$ and $\dot{z}_{zyl}$ are the cylinder acceleration and velocity, $T_W$ the time constant, $A_{zyl}$ the cross-sectional area of the cylinder, $u_W$ the input voltage of the servo valve and $K_{VW}$ the proportional constant of flow rate to $u_W$.

Figure 3:
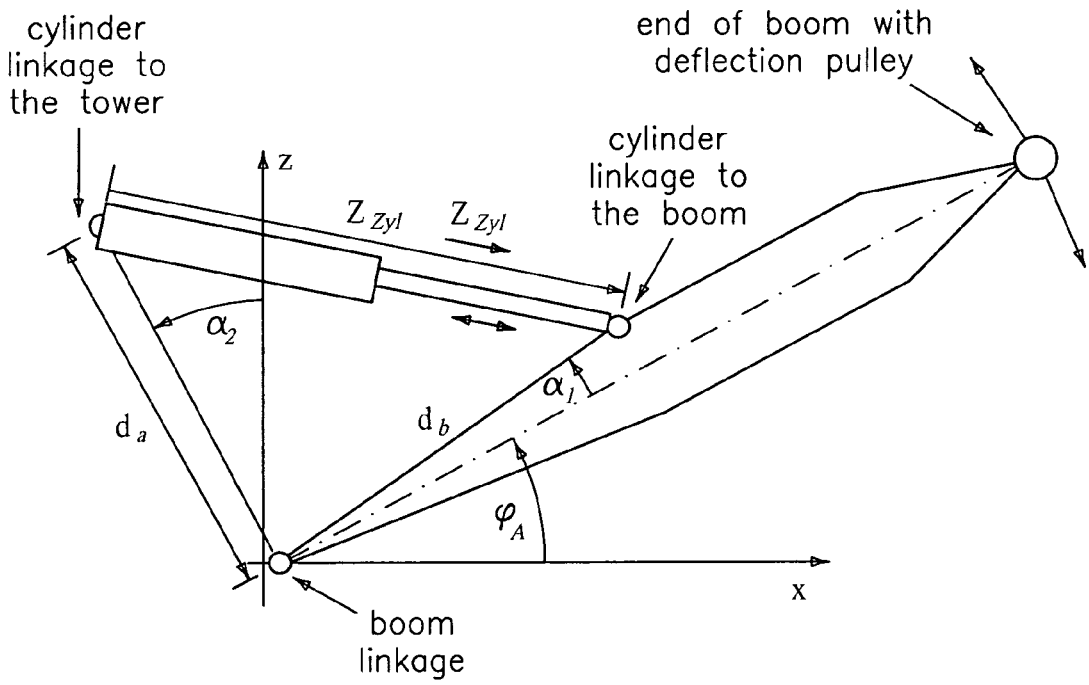
FIG. 3 shows a schematic representation of the cylinder kinematics.

FIG. 3 shows a schematic representation of the kinematics of the actuator the geometric constants $d_a$, $d_b$, $\alpha_1$, $\alpha_2$. In order to obtain a transformation from cylinder coordinates ($z_{zyl}$) to outreach coordinates ($r_A$) the kinematical equation $$r_A(z_{zyl}) = l_A\cos\left(\alpha_{A0} - \arccos\left(\frac{d_a^2 + d_b^2 - z_{zyl}^2}{2d_a d_b}\right)\right) \tag{1.3}$$

is differentiated.

$$\dot{r}_A = -l_A\sin(\phi_A)K_{Wz1}(\phi_A)\dot{z}_{zyl}$$

$$\ddot{r}_A = -l_A\sin(\phi_A)K_{Wz1}(\phi_A)\ddot{Z}_{zyl} - K_{Wz3}(\phi_A)\dot{z}_{zyl}^2 \tag{1.4}$$

$K_{Wz1}$ and $K_{Wz3}$ describe the dependency from the geometric constants $d_a$, $d_b$, $\alpha_1$, $\alpha_2$ and the luffing angle $\phi_A$. (see FIG. 3) $l_A$ is the length of the boom.

Formulating the fist order behavior of the actuator in outreach coordinates by utilizing equations (1.4) leads to a nonlinear differential equation.

$$\ddot{r}_A = -\underbrace{\frac{K_{Wz3}}{l_A^2\sin^2(\varphi_A)K_{Wx1}^2}}_{a}\dot{r}_A^2 - \underbrace{\frac{1}{T_W}}_{b}\dot{r}_A - \underbrace{\frac{K_{VW}l_A\sin(\varphi_A)K_{Wz1}}{T_W A_{zyl}}}_{m}u_l \tag{1.5}$$

To present the nonlinear model in the form $$\dot{\underline{x}}_l = \underline{f}_l(\underline{x}_l) + \underline{g}_l(\underline{x}_l)\cdot u_l$$

$$y_l = h_l(\underline{x}_l) \tag{1.6}$$

equations (1.1) and (1.6) are used. Hereby the state $\underline{x}=[r_A\ \dot{r}_A\ \phi_{Sr}\ \dot{\phi}_{Sr}]^T$ used as an input and the radial position of the load $y=r_{LA}$ provided as output lead to:

$$\underline{f}_l(\underline{x}_l) = \begin{bmatrix} x_{l,2} \\ -ax_{l,2}^2 - bx_{l,2} \\ x_{l,4} \\ -\frac{g}{l_S}\sin(x_{l,3}) + \frac{\cos(x_{l,3})}{l_S}(ax_{l,2}^2 + bx_{l,2}) \end{bmatrix}; \tag{1.7}$$

$$\underline{g}_l(\underline{x}_l) = \begin{bmatrix} 0 \\ -m \\ 0 \\ \frac{\cos(x_{l,3})m}{l_S} \end{bmatrix} \quad h_l(\underline{x}_l) = x_{l,1} + l_S\sin(x_{l,3})$$

1.2. Flatness Based Control Approach

The following considerations are made assuming that the right side of the differential equation for the load sway can be linearized. Hence the excitation of the radial load sway is decoupled from the radial rope angle $\phi_{Sr}$.

$$\ddot{\varphi}_{Sr} + \frac{g}{l_S}\sin(\varphi_{Sr}) = \frac{1}{l_S}\ddot{r}_A \tag{1.8}$$

In order to find a flat output for the simplified nonlinear system the relative degree has to be ascertained.

1.2.1 Relative Degree

The relative degree is defined by the following conditions:

$$L_{\underline{g}_l}L_{\underline{f}_l}^{\,i}h_l(\underline{x}_l) = 0\ \forall i = 0, \ldots r-2$$

$$L_{\underline{g}_l}L_{\underline{f}_l}^{\,r-1}h_l(\underline{x}_l) \neq 0\ \forall x \in R^n \tag{1.9}$$

The operator $L_{\underline{f}_l}$ represents the Lie derivative along the vector field $\underline{f}_l$ and $L_{\underline{g}_l}$ along the vector field $g_l$ respectively. With the real output $y_l = x_{l,1} + l_S\,\mathrm{sing}(x_{l,3})$ a relative degree of r=2 is obtained. Because the order of the simplified nonlinear model is 4, $y_l$ is a no flat output. But with a new output $y_l^* = h_l^*(\underline{x}_l) = x_{l,1} + l_S x_{l,3}$ a relative degree of r=4 is obtained. Assuming that only small radial rope angles occur, the difference between the real output $y_l$ and the flat output $y_l^*$ can be neglected.

1.2.2 Exact Linearization

Because the simplified system representation is differentially flat an exact linearization can be done. Therefore a new input is defined as $v = \ddot{y}_l^*$ and linearizing control signal $u_l$ is calculated by $$u_l = \frac{-L'_{\underline{f}_l} h_l^*(\underline{x}_l) + v_l}{L_{\underline{f}_l} L'^{-1}_{\underline{f}_l} h_l^*(\underline{x}_l)}; \quad v_l \ldots \text{ new input}$$

$$= \frac{g\sin(x_{l,3})x_{l,4}^2 - g\cos(x_{l,3})\left(-\frac{g}{l_S}\sin(x_{l,3}) + \frac{a}{l_S}x_{l,2}^2 + \frac{b}{l_S}x_{l,2}\right) + v_l}{\frac{gm}{l_S}\cos(x_{l,3})} \tag{1.10}$$

In order to stabilize the resulting linearized system a feedback of the error between the reference trajectory and the derivatives of the output $y_l^*$ is derived.

$$u_l = \frac{-L'_{\underline{f}_l} h_l^*(\underline{x}_l) + v_l - \sum_{i=0}^{r-1} k_{l,i}\left[L^i_{\underline{f}_l} h_l^*(\underline{x}_l) - y^{(i)}_{l,ref}\right]}{L_{\underline{g}_l} L'^{-1}_{\underline{f}_l} h_l^*(\underline{x}_l)} \tag{1.11}$$

Figure 4:
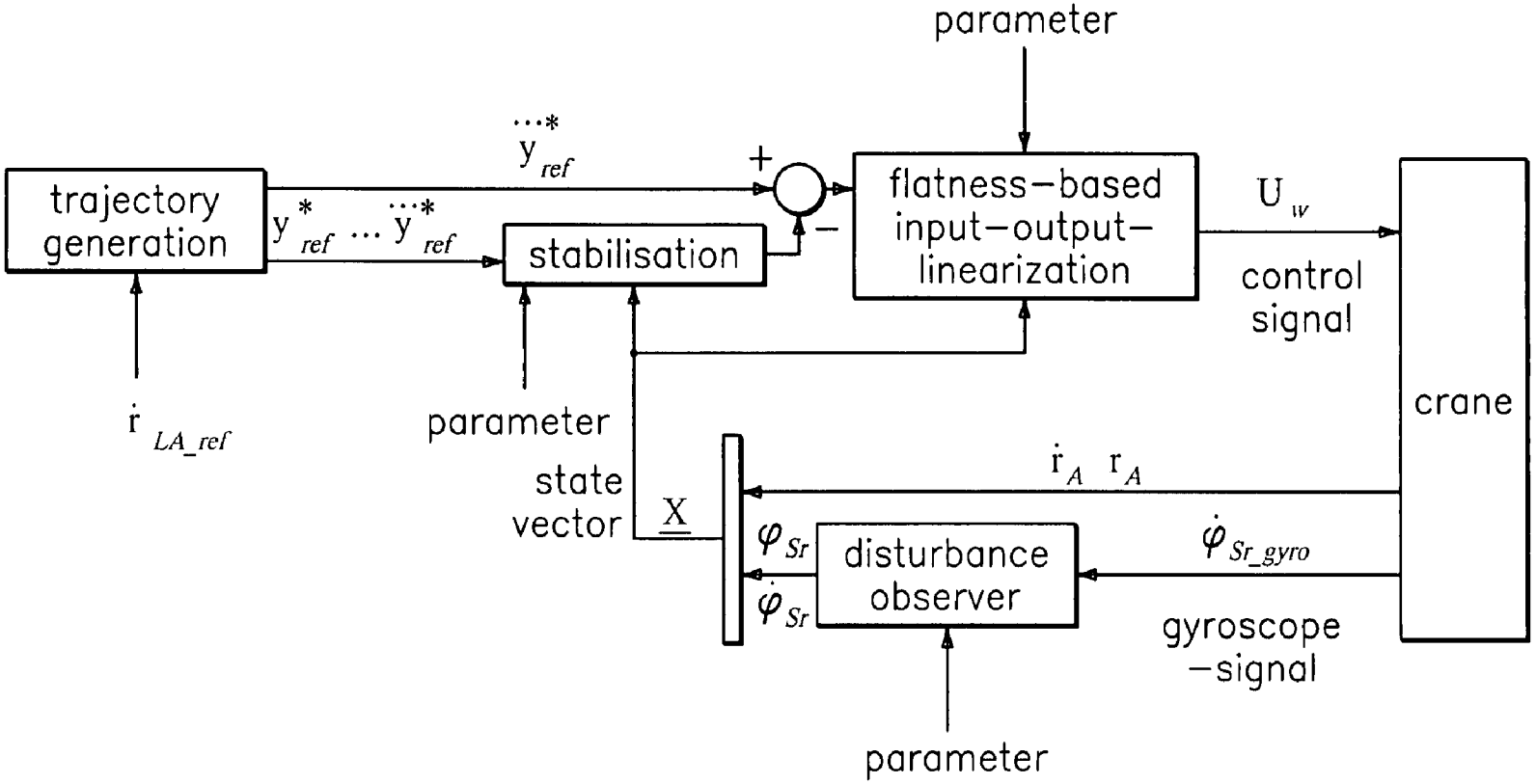
FIG. 4 shows a first embodiment of a control structure according to the present invention.

The feedback gains $k_{l,i}$ are obtained by the pole placement technique. FIG. 4 shows the resulting control structure of the linearized and stabilized system.

The tracking controller bases on the simplified load sway ODE (1.8) and not on the load sway ODE (1.1). Moreover for the controller design the fictive output $y_l^*$ is used. Those both simplifications could cause for the resulting tracking behavior disadvantages. At worst the internal dynamics could be instable which means that the presented exact linearization method can not be realized. For that reason in the following the stability performance of the internal dynamics is investigated.

1.2.3 Internal Dynamics

Without the above mentioned simplification of the dynamical model, the relative degree in respect of the real output $y_l = x_{l,1} + l_X \sin(x_{l,3})$ equals to r=2. As the system order equals to n=4, the internal dynamics has to be represented by an ODE of the second order. Via a deliberately chosen diffeomorph state transformation $$z_{1,1} = \phi_l(\underline{x}_l) = y_l = x_{l,1} + l_S \sin x_{l,3}$$

$$z_{l,2} = \phi_2(\underline{x}_l) = \dot{y}_l = x_{l,2} + l_S x_{l,4} \cos x_{l,3}$$

$$z_{l,3} = \phi_3(\underline{x}_l) = x_{l,1}$$

$$z_{l,4}\phi_4(\underline{x}_l) = x_{l,2} \tag{1.12}$$

one can derive the internal dynamics in new coordinates $$\dot{z}_{l,3} = (L_{\underline{f}}\phi_3 + L_{\underline{g}}\phi_3 u_l) \circ \underline{\Phi}^{-1}(\underline{z}_l)$$

$$= z_{l,4}$$

$$\dot{z}_{l,4} = (L_{\underline{f}}\phi_4 + L_{\underline{g}}\phi_4 u_l) \circ \underline{\Phi}^{-1}(\underline{z}_l)$$

$$= (-bx_{l,2} - \alpha x_{l,2}^2 - mu_l) \circ \underline{\Phi}^{-1}(\underline{z}_l)$$

$$= -bz_{l,4} - \alpha z_{l,4}^2 - mu_l \tag{1.13}$$

The internal dynamics (1.13) can be expressed as well in original coordinates which leads to the ODE of the luffing movement (equation (1.5)):

$$\dot{x}_{l,1} = x_{l,2}$$

$$\dot{x}_{l,2} = -bx_{l,2} - \alpha x_{l,2}^2 - mu_l \tag{1.14}$$

The control input $u_l$ can be derived by the nominal control signal (1.10). Thereby the internal dynamics yields to:

$$\dot{x}_{l,1} = x_{l,2} \tag{15)(1.15}$$

$$\dot{x}_{l,2} = -bx_{l,2} - ax_{l,2}^2 - m\frac{g\sin(x_{l,3})x_{l,4}^2}{\frac{gm}{l_S}\cos(x_{l,3})} - m\frac{g\cos(x_{l,3})\left(-\frac{g}{l_S}\sin(x_{l,3}) + \frac{a}{l_S}x_{l,2}^2 + \frac{b}{l_S}x_{l,2}\right) + \dddot{y}_l^*}{\frac{gm}{l_S}\cos(x_{l,3})}$$

Hereby the ODE (1.15) is influenced by the radial rope angle $x_{l,3}$, the angular velocity $X_{l,4}$ and the fourth derivative of the fictive output $\dddot{y}_l^*$. As the internal dynamics (1.15) is nonlinear, the global stability behavior cannot be easily proven. For the practical point of view it is sufficient to analyze the stability performance when the fictive output (and derivatives) equals to zero. This condition leads to the ODE of the zero dynamics, which is computed in the following.

1.2.4 Zero Dynamics

Assuming that the so called zeroing of the fictive output $$y_l^* = \dot{y}_l^* = \ddot{y}_l^* = \dddot{y}_l^* = 0 \tag{1.16}$$

can be realized by the presented controller (1.11), one can easily shown, that the load sway has to be fully damped $$x_{l,3} = x_{l,4} = 0 \tag{1.17}$$

Using the condition (1.17), the internal dynamics (1.15) represents finally the zero dynamics:

$$\dot{x}_{l,1} = x_{l,2}$$

$$\dot{x}_{l,2} = -bx_{l,2} - \alpha x_{l,2}^2 \tag{1.18}$$

The zero dynamics (1.18) equals to the homogeny part of the ODE of the hydraulic drive. As the parameters $b>0, \alpha>0$ (see equation (1.5)), the outreach velocity $x_{l,2}$ is asymptotically stable. Due to the fact, that the outreach position $x_{l,1}$ is obtained by integration, the zero dynamics is not instable but behaves like an integrator. As the outreach position is measured and becomes not instable, the presented exact linearization strategy can be practically realized.

1.3 Measurement Results

Figure 5:
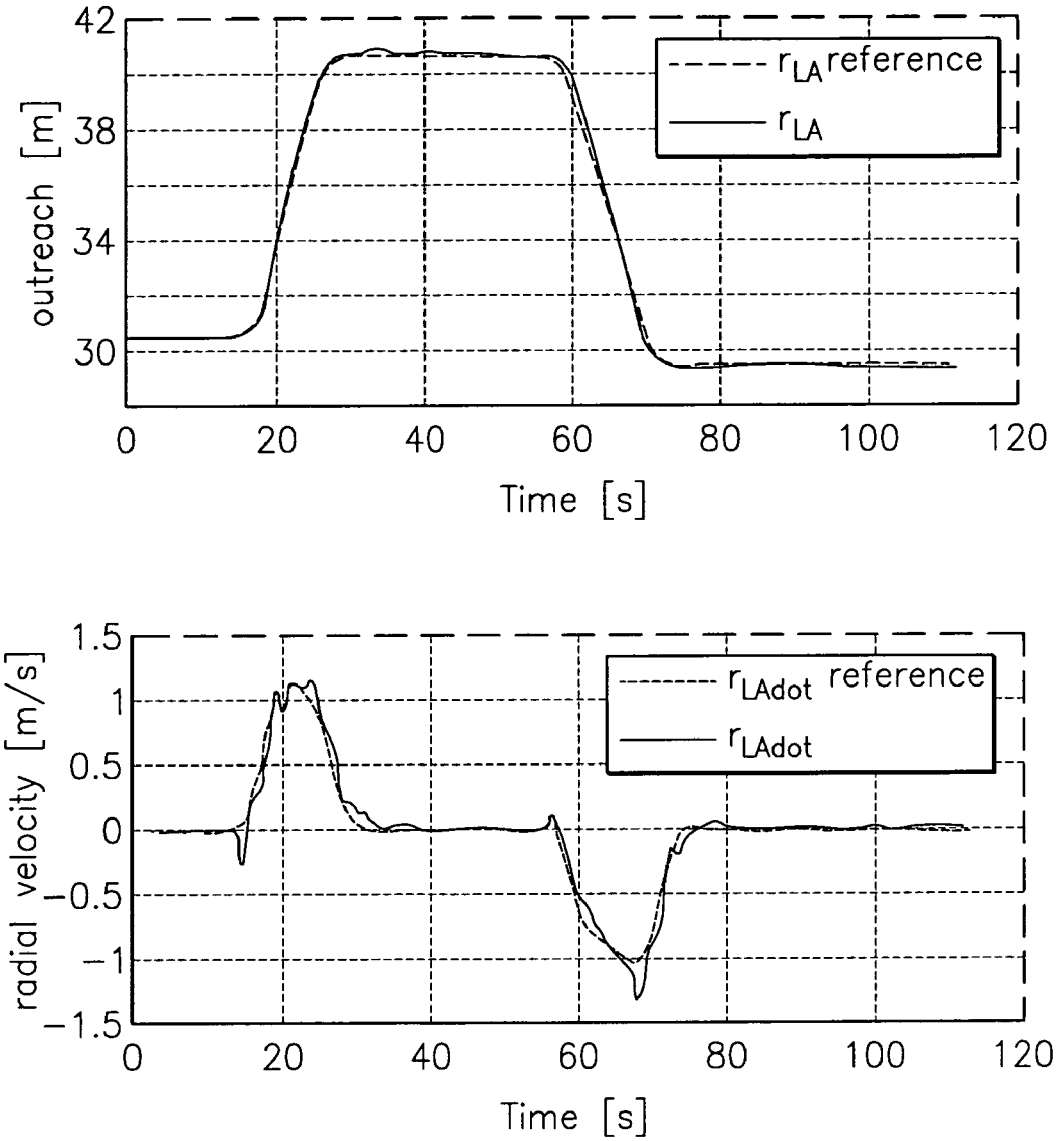
FIG. 5 shows the outreach and radial velocity of a luffing movement controlled by the first embodiment.

In this section, measurement results of the boom crane LHM 322 are presented. FIG. 5 shows the control of a luffing movement using the first embodiment. The upper diagram shows that the radial load position tracks the reference trajectory accurate. The overshoot for both directions is less then 0.2 m. which is almost negligible for a rope length of 35 m. The lower diagram shows the corresponding velocity of the load and the reference trajectory is presented.

Figure 6:
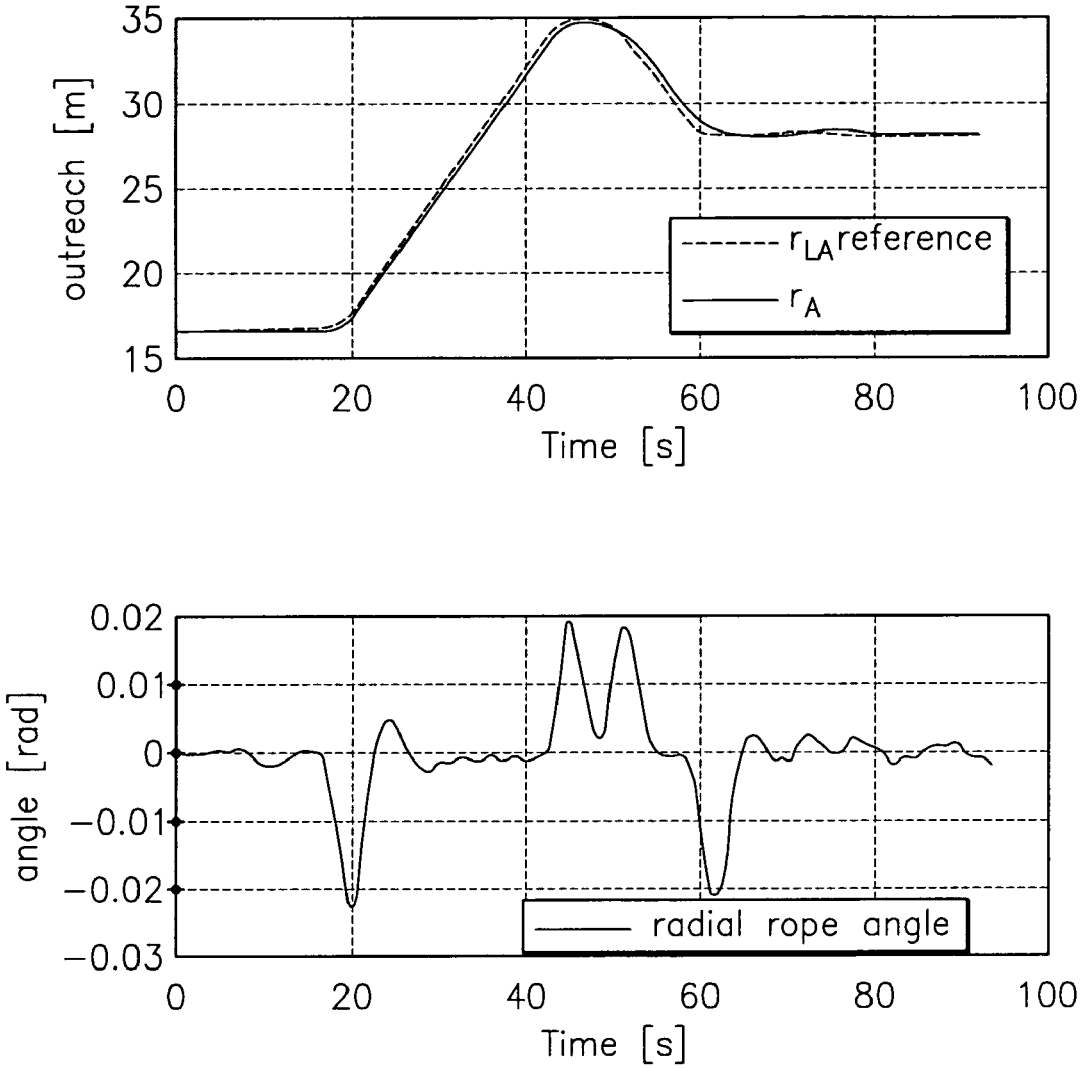
FIG. 6 shows the outreach and radial rope angle for two opposite luffing movements controlled by the first embodiment.

Another typical maneuver during transshipment processes are maneuvers characterized by two successive movements with opposite directions. The challenge is to gain a smooth but fast transition between the two opposite movements. The resulting radial load position and radial rope angle are presented in FIG. 6. In order to reject the load sway during the crane operation, there are compensating movements of the boom especially at the beginning and at the end of a motion, which can be seen in the corresponding diagram in FIG. 7. The measurement results show a very low residual sway at the target positions and good target position accuracy.

2. The Second Embodiment

In the second embodiment of the present invention, the coupling of a slewing and luffing motion is taken into account. This coupling is caused by the centrifugal acceleration of the load in radial direction during a slewing motion. As in the first embodiment, a nonlinear model for a rotary boom crane is derived utilizing the method of Newton/Euler. Dominant nonlinearities such as the kinematics of the hydraulic actuator (hydraulic cylinder) are considered. Additionally, in the second embodiment, the centrifugal acceleration of the load during a stewing motion of the crane is taken into account. The centrifugal effect, which results in the coupling of the stewing and luffing motion, has to be compensated in order to make the cargo transshipment more effective. This is done by first defining the centrifugal effect as a time-varying disturbance and analyzing it concerning decoupling conditions. And secondly the nonlinear model is extended by a second order disturbance model. With this extension it is possible to decouple the disturbance and to derive a input/output linearizing control law. The drawback is that not only the disturbance but also the new states of the extended model must be measurable. Because as this is possible for the here given application case a good performance of the nonlinear control concept is achieved. The nonlinear controller is implemented at the Harbour Mobil Crane and measurement results are obtained. These results validate the exact tracking of the reference trajectory with reduced load sway.

The second embodiment is used for the same crane as the first embodiment already described above and shown in FIG. 1. In case of such rotary boom cranes the slewing and luffing movements are coupled. That means a slewing motion induces not only tangential but also radial load oscillations because of the centrifugal force. This leads to the first challenge for the advancement of the existing control concept, the synchronization of the slewing and luffing motion in order to reduce the tracking error and ensure a swing-free transportation of the load. The second challenge is the accurate tracking of the crane load on the desired reference trajectory during luffing motion because of the dominant nonlinearities of the dynamic model.

2.1 Nonlinear Model of the Crane

The performance of the crane's control is mainly measured by fast damping of load sway and exact tracking of the reference trajectory. To achieve these control objectives the dominant nonlinearities have to be considered in the dynamic model of the luffing motion.

The first part of this model is derived by utilizing the method of Newton/Euler.

Making the Simplifications rope's mass and elasticity is neglected,
the load is a point mass,
coriolis terms are neglected result in the following differential equation which characterizes the radial load sway. In contrast to the first embodiment, the centrifugal acceleration is taken into account, giving the differential equation $$\ddot{\varphi}_{Sr} + \frac{g}{l_S}\sin(\varphi_{Sr}) = -\frac{\cos(\varphi_{Sr})}{l_S}\ddot{r}_A + \ldots\frac{\cos(\varphi_{Sr})}{l_S}(r_A + l_S\sin(\varphi_{Sr}))\dot{\varphi}_D^2 \tag{2.1}$$

Figure 7:
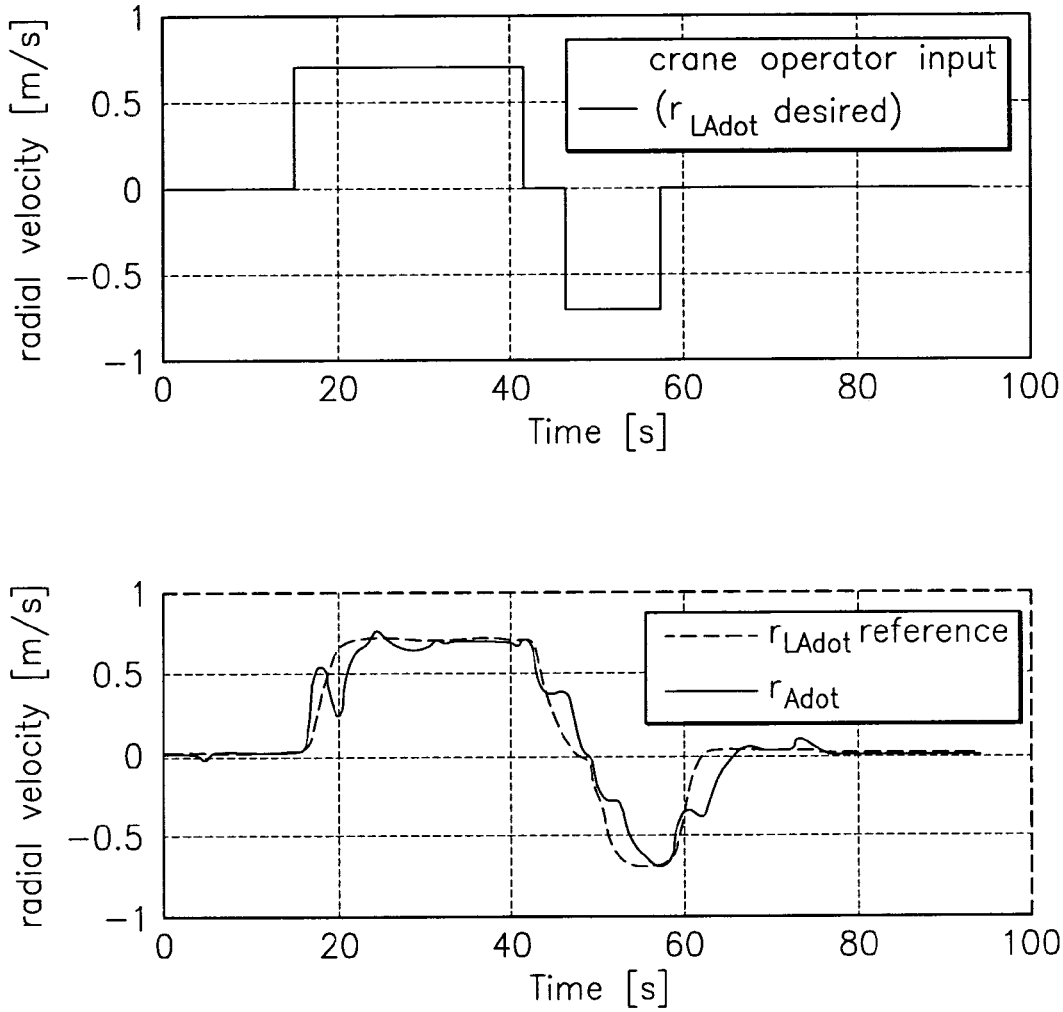
FIG. 7 shows the crane operator input and the radial velocities of the boom head and the load showing counter-movements according to the present invention.
Figure 8:
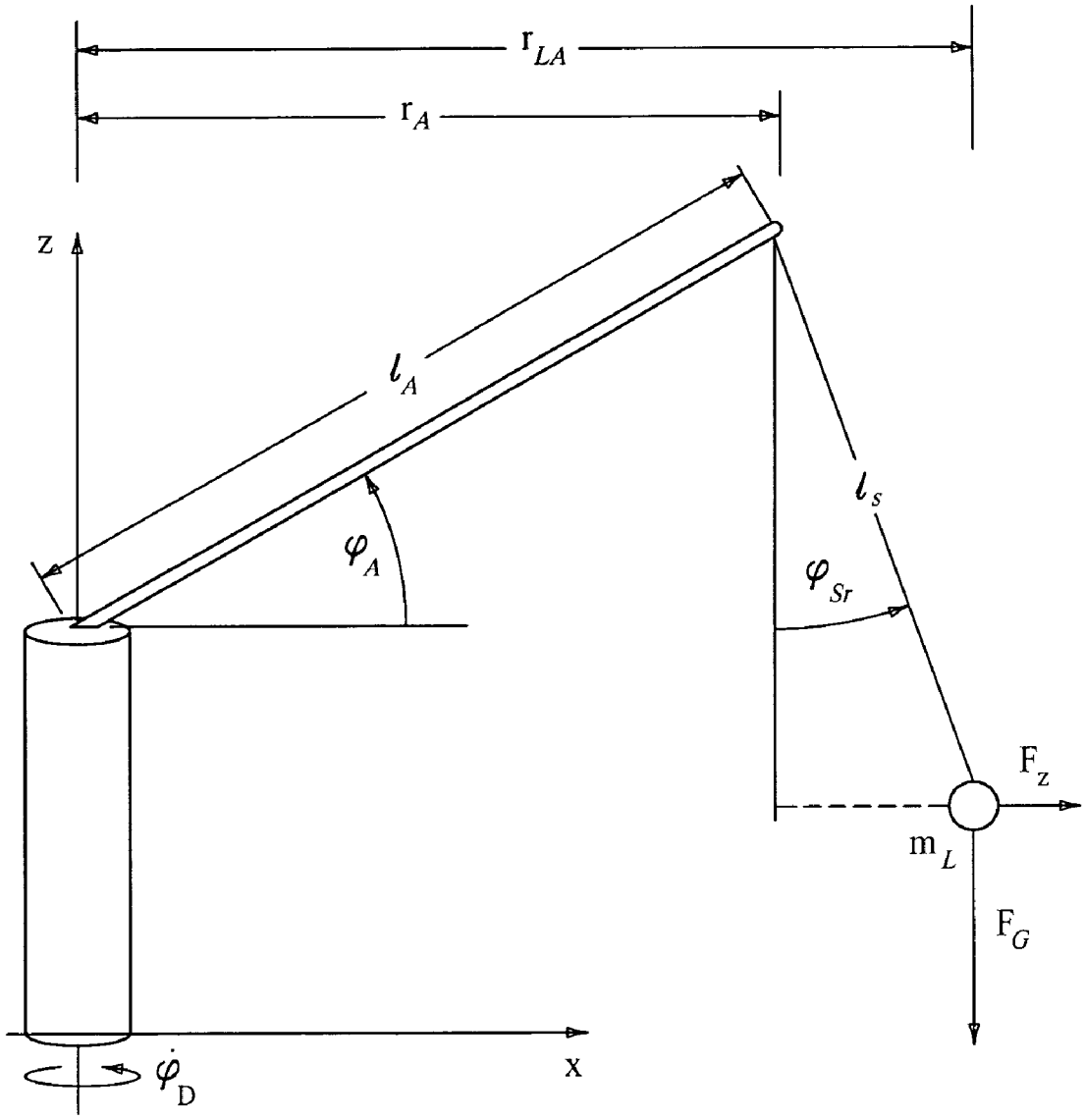
FIG. 8 shows a schematic representation of the luffing and rotational movement of a boom crane.
Figure 9:
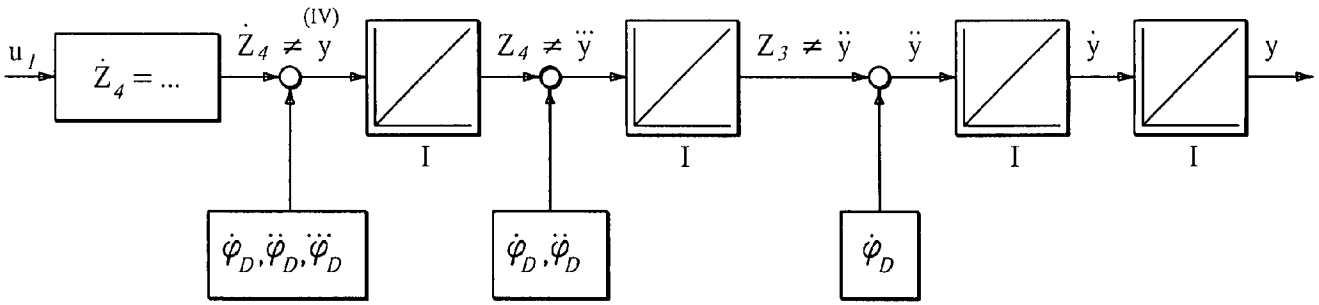
FIG. 9 shows a schematic representation of a model architecture in control canonical form.
Figure 10:
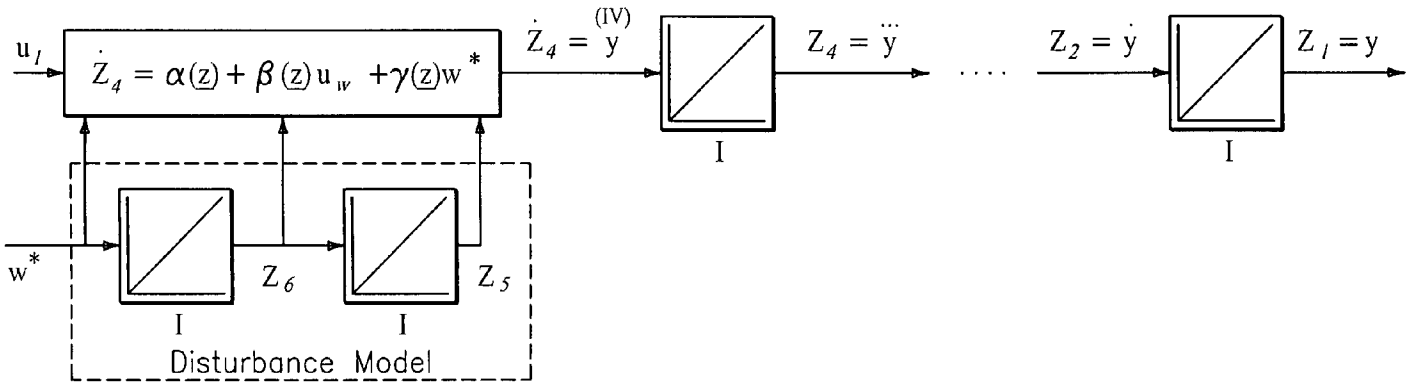
FIG. 10 shows a schematic representation of a model architecture in extended form according to a second embodiment of the present invention.

As shown in FIG. 7, $\phi_{Sr}$ is the radial rope angle, $\ddot{\phi}_{Sr}$ the radial angular acceleration, $\dot{\phi}_D$ the cranes rotational angular velocity, $l_S$ the rope length, $r_A$ the distance from the vertical axe to the end of the boom, $\ddot{r}_A$ the radial acceleration of the end of the boom and g the gravitational constant. $F_Z$ represents the centrifugal force, caused by a slewing motion of the boom crane.

The second part of the nonlinear model is obtained by taking the actuators kinematics and dynamics into account. This actuator is a hydraulic cylinder attached between tower and boom. Its dynamics can be approximated with a first order system.

Considering the actuators dynamics, the differential equation for the motion of the cylinder is obtained as follows $$\ddot{z}_{zyl} = -\frac{1}{T_W}\dot{z}_{zyl} + \frac{K_{VW}}{T_W A_{zyl}}u_l \tag{2.2}$$

Where $\ddot{z}_{zyl}$ and $\dot{z}_{zyl}$ are the cylinder acceleration and velocity respectively, $T_W$ the time constant, $A_{zyl}$ the cross-sectional area of the cylinder, $u_l$ the input voltage of the servo valve and $K_{VW}$ the proportional constant of flow rate to $u_l$. In order to combine equation (2.1) and (2.2) they have to be in the same coordinates. Therefore a transformation of equation (2.2) from cylinder coordinates ($Z_{zyl}$) to outreach coordinates ($r_A$) with the kinematical equation $$r_A(z_{zyl}) = l_A\cos\left(\alpha_{A0} - \arccos\left(\frac{d_a^2 + d_b^2 - z_{zyl}^2}{2d_a d_b}\right)\right) \tag{2.3}$$

and its derivatives $$\dot{r}_A = -l_A\sin(\phi_A)K_{Wz1}(\phi_A)\dot{z}_{zyl}$$

$$\ddot{r}_A = -l_A\sin(\phi_A)K_{Wz1}(\phi_A)\ddot{z}_{xyl} - K_{Wz3}(\phi_A)\dot{z}_{zyl}^2 \tag{2.4}$$

is necessary. Where the dependency from the geometric constants $d_a$, $d_b$, $\alpha_1$, $\alpha_2$ and the luffing angle $\phi_A$ is substituted by $K_{Wz1}$ and $K_{Wz3}$. The geometric constants, the luffing angle and $l_A$, which is the length of the boom, are shown in FIG. (3).

As result of the transformation, equation (2.2) can be displayed in outreach coordinates.

$$\ddot{r}_A = -\underbrace{\frac{K_{Wz3}}{l_A^2\sin^2(\varphi_A)K_{Wz1}^2}}_{a}\dot{r}_A^2 - \underbrace{\frac{1}{T_W}}_{b}\dot{r}_A - \underbrace{\frac{K_{VW}l_A\sin(\varphi_A)K_{Wz1}}{T_W A_{zyl}}}_{m}u_l \tag{2.5}$$

In order to obtain a nonlinear model in the input affine form $$\dot{\underline{x}}_l = \underline{f}_l(\underline{x}_l) + \underline{g}_l(\underline{x}_l)u_l + \underline{p}_l(\underline{x}_l)w$$

$$y_l = h_l(\underline{x}_l) \tag{2.6}$$

equations (2.1) and (2.5) are used. The second input w represents the disturbance which is the square of the crane's rotational angular speed $\dot{\phi}_D^2$. With the input state defined as $\underline{x}_l = [r_A\ \dot{r}_A\ \phi_{Sr}\ \dot{\phi}_{Sr}]^T$ and the radial position of the load as output $y_l = r_{LA}$ follow the vector fields $$\underline{f}_l(\underline{x}_l) = \begin{bmatrix} x_{l,2} \\ -ax_{l,2}^2 - bx_{l,2} \\ x_{l,4} \\ -\frac{g}{l_S}\sin(x_{l,3}) + \frac{\cos(x_{l,3})}{l_S}(ax_{l,2}^2 + bx_{l,2}) \end{bmatrix} \tag{2.7}$$

-continued $$\underline{g}_l(\underline{x}_l) = \begin{bmatrix} 0 \\ -m \\ 0 \\ \frac{\cos(x_{l,3})m}{l_S} \end{bmatrix}; \underline{p}_l(\underline{x}_l) = \begin{bmatrix} 0 \\ 0 \\ 0 \\ \frac{\cos(x_{l,3})(x_{l,1} + l_S\sin(x_{l,3}))}{l_S} \end{bmatrix}$$

and the function $$h_l(\underline{x}_l)=x_{l,1}+l_S \sin(x_{l,3}) \tag{2.8}$$

for the radial load position.

2.2 Nonlinear Control Approach

The following considerations are made assuming that the right side of the differential equation for the load sway can be linearized.

$$\ddot{\varphi}_{Sr} + \frac{g}{l_S}\sin(\varphi_{Sr}) = -\frac{1}{l_S}\ddot{r}_A + \frac{1}{l_S}(r_A + l_S\varphi_{Sr})\dot{\varphi}_D^2 \tag{2.9}$$

In order to find a linearizing output for the simplified nonlinear system the relative degree has to be ascertained.

System's Relative Degree

The relative degree concerning the systems output is defined by the following conditions $$L_{\underline{g}_l}L_{\underline{f}_l}^i h_l(\underline{x}_l)=0 \ \forall i=0, \ldots r-2$$

$$L_{\underline{g}_l}L_{\underline{f}_l}^{r-1}h_l(\underline{x}_l)\neq 0 \ \forall x\in R^n \tag{2.10}$$

The operator $L_{\underline{f}_l}$ represents the Lie derivative along the vector field $\underline{f}_l$ and $L_{\underline{g}_l}$ along the vector field $\underline{g}_l$ respectively. With the real output $$y_l=x_{l,3}+l_S \sin(x_{l,3}) \tag{2.11}$$

a relative degree of r=2 is obtained. Because the order of the simplified nonlinear model is 4, $y_l$ is not a linearizing output. But with a new output $$y_{l*}=h_l^*(\underline{x}_l)=x_{l,1}+l_s x_{l,3} \tag{2.12}$$

a relative degree of r=4 is obtained. Assuming that only small radial rope angles occur, the difference between the real output $y_l$ and the flat output $y_l^*$ can be neglected.

Disturbance's Relative Degree

The relative degree with respect to the disturbance is defined as follows:

$$L_{\underline{p}_l}L_{\underline{f}_l}^i h_l(\underline{x}_l)=0 \ \forall i=0, \ldots r_d-2 \tag{2.13}$$

Here it is not important whether $r_d$ is well defined or not. Therefore the second condition can be omitted. Applying condition (2.13) to the reduced nonlinear system (equations (2.6), (2.7) and simplification of equation (2.9)) with the linearizing output $y_l^*$ the relative degree is $r_d=2$.

Disturbance Decoupling

Referring to Isidori (A. Isidori, C. I. Byrnes, "Output Regulation of Nonlinear Systems", Transactions on Automatic Control, Vol. 35, No. 2, pp. 131-140, 1990), any disturbance satisfying the following condition can be decoupled from the output.

$$L_{\underline{p}}L_{\underline{f}}^i h(\underline{x})=0 \ \forall i=0, \ldots r-1 \tag{2.14}$$

This means the disturbance's relative degree $r_d$ has to be larger than the system's relative degree. When there is the possibility to measure the disturbance a slightly weaker condition has to be fulfilled. In this case it is necessary that the relative degrees $r_d$ and r are equal. Due to these two conditions it is in a classical way impossible to achieve an output behaviour of our system which is not influenced by the disturbance. This can also easily be seen in FIG. (9), where the system is displayed in the Control Canonical Form with input$_{u_l}$, states $z_1, \ldots, Z_4$ and disturbance $\dot{\phi}_D$.

Model Expansion

To obtain a disturbance's relative degree which is equal to the system's relative degree a model expansion is required. With the introduction of $r-r_d=2$ new states which are defined as follows, $$\sqrt{w}=x_{l,5}=\dot{\phi}_D$$

$$d/dt\ (\sqrt{w})=x_{l,6}=\ddot{\phi}_D$$

$$d^2/dt^2\ (\sqrt{w})=\dot{x}_{l,6}=\dddot{\phi}_{LD}=w^* \tag{2.15}$$

the new model is described by the following differential equations $$\dot{x}_l = \underbrace{\begin{bmatrix} f_l(\underline{x}_l) + p_l(\underline{x}_l)x_{l,5}^2 \\ x_{l,6} \\ 0 \end{bmatrix}}_{f_l^*(x)} + \underbrace{\begin{bmatrix} g_l(\underline{x}_l) \\ 0 \\ 0 \end{bmatrix}}_{g_l^*(x)} u_l + \underbrace{\begin{bmatrix} 0 \\ 0 \\ 0 \end{bmatrix}}_{p_l^*(x)} w^* \tag{2.16}$$

$$y_l^* = h_l^*(\underline{x}_l)$$

This Expansion remains the system's relative degree unaffected whereas the disturbance's relative degree is enlarged by 2. The additional dynamics can be interpreted as a disturbance model. The expanded model, whose structure is shown in FIG. (10), satisfies the condition (2.14) and the disturbance decoupling method described by Isidori can be used.

Input/Output Linearization

Hence the expanded model has a system and disturbance relative degree of 4 and the disturbance w* is measurable, it can be input/output linearized and disturbance decoupled with the following control input $$u_{l,Lin} = \underbrace{-\frac{L_{\underline{f}_l^*}^r h_l^*(\underline{x}_l)}{L_{\underline{g}_l^*}L_{\underline{f}_l^*}^{r-1}h_l^*(\underline{x}_l)}}_{Linearization} \underbrace{-\frac{L_{\underline{p}_l^*}L_{\underline{f}_l^*}^{r-1}h_l^*(\underline{x}_l)}{L_{\underline{g}_l^*}L_{\underline{f}_l^*}^{r-1}h_l^*(\underline{x}_l)}w^*}_{Decoupling} + \underbrace{\frac{v_l}{L_{\underline{g}_l^*}L_{\underline{f}_l^*}^{r-1}h_l^*(\underline{x}_l)}}_{\substack{Tracking \\ v \ldots new\ input}} = \tag{2.17}$$

$$-\left(\begin{array}{l} -\frac{(4x_{l,4}x_{l,5}x_{l,6} + x_{l,3}x_{l,5}^4 + 2x_{l,3}x_{l,6}^2)l_s^2}{mg\cos(x_{l,3})} - \\ \frac{(gx_{l,4}^2\sin(x_{l,3}))l_S}{mg\cos(x_{l,3})} - \\ \ldots\frac{\left(-gx_{l,5}^2\sin(x_{l,3}) - gx_{l,3}x_{l,5}^2\cos(x_{l,3}) + 4x_{l,2}x_{l,5}x_{l,6} + 2x_{l,1}x_{l,6}^2\right)l_S}{mg\cos(x_{l,3})} + \\ (x_{l,1}x_{l,5}^4)l_S + \\ \ldots\frac{g\cos(x_{l,3})(ax_{l,2}^2 + bx_{l,2} + x_{l,5}^2x_{l,1} - g\sin(x_{l,3}))}{mg\cos(x_{l,3})} \end{array}\right) -$$

-continued $$\ldots\left(-\frac{2l_S(x_{l,1}+l_S x_{l,3})x_{l,5}}{\text{mg}\cos(x_{l,3})}w^*\right)+\left(\frac{-l_S v_l}{\text{mg}\cos(x_{l,3})}\right)$$

To stabilize the resulting linearized and decoupled system a feedback term is added. The term (equation (2.18)) compensates the error between the reference trajectories $\underline{y}_{l,ref}*$ and the derivatives of the output $y_l*$.

$$u_{l,Stab}=\frac{\sum_{i=0}^{r-1}k_{l,i}\left[L_{\underline{f}_l^*}^{i}\cdot h_l^*(\underline{x}_l)-y_{l,ref}^{(i)}\right]}{L_{\underline{g}_l^*}\cdot L_{\underline{f}_l^*}^{r-1}\cdot h_l^*(\underline{x}_l)} \tag{2.18}$$

Figure 11:
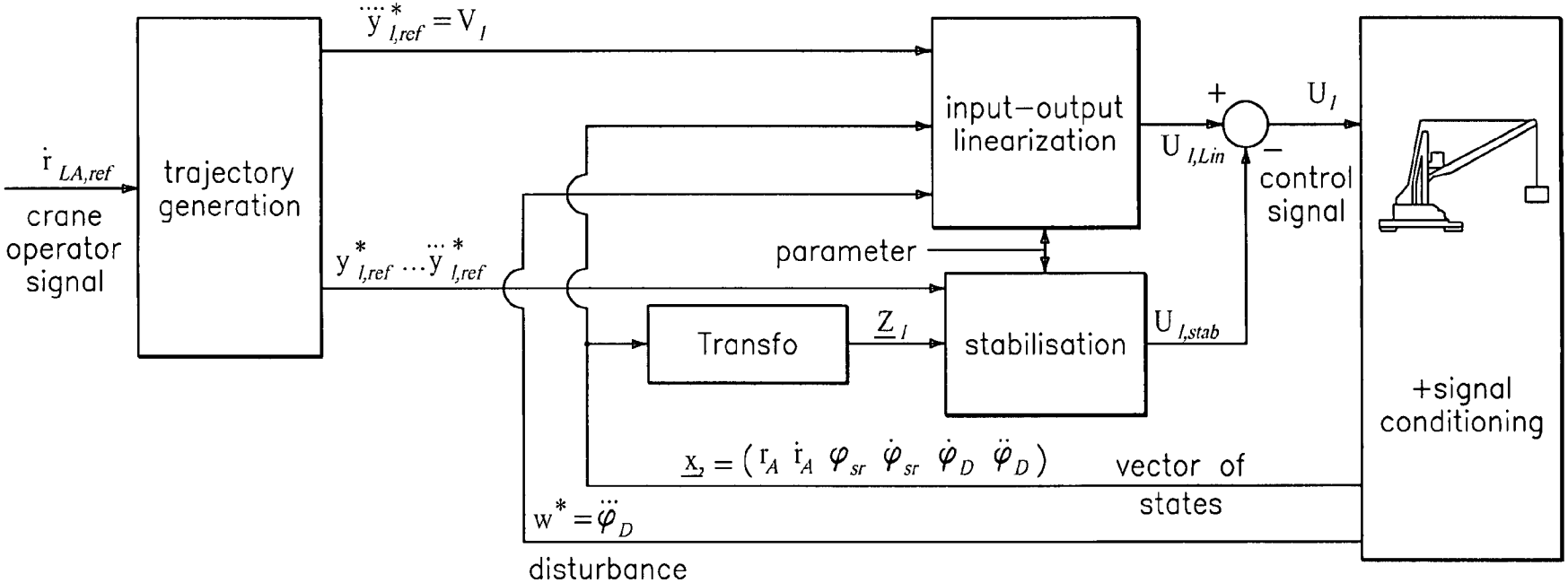
FIG. 11 shows the second embodiment of a control structure according to the present invention.

The feedback gains $k_{l,i}$ are obtained by the pole placement technique. FIG. 11 shows the resulting control structure of the linearized, decoupled and stabilized system with the following complete input $$u_l=u_{l,Lin}-u_{l,Stab} \tag{2.19}$$

The effect caused by the usage of the fictive output in stead of the real one is discussed above in relation to the first embodiment. There it is shown that the resulting internal dynamics near the steady state is at least marginal stable. Therefore the fictive output can be applied for the controller design.

Internal Dynamics

Another effect of the model expansion has to be considered. Hence the system order increases from n=4 to n*=6 but the system's relative degree remains constant, the system loses its flatness property. Thus it is only possible to obtain an input/output linearization in stead of an exact linearization. The result is a remaining internal dynamics of second order. To investigate the internal dynamics a state transformation to the Byrnes/Isidori form is advantageous. The first r=4 new states can be computed by the Lie derivations (see equation (2.20)). The last two can be chosen freely. The only condition is that the resulting transformation must be a diffeomorph transformation. In order to shorten the length of the third an fourth equation, the linearizing output and its derivative have been substituted.

$$z_{l,1}=\phi_1(\underline{x}_l)=y_l=h_l^*(\underline{x}_l)=x_{l,1}+l_S x_{l,3}$$

$$z_{l,2}=\phi_2(\underline{x}_l)=\dot{y}_l=L_{f_l}h_l^*(\underline{x}_l)=x_{l,2}+l_S x_{l,4}$$

$$z_{l,3}=\phi_3(\underline{x}_l)=\ddot{y}_l=L_{f_l}^2.h_l^*(\underline{x}_l)=-g\sin x_{l,3}+x_{l,5}^2 z_{l,1}$$

$$z_{l,4}=\phi_4(\underline{x}_l)=\dddot{y}_l^*=L_{f_l}^3.h_l^*(\underline{x}_l)=-x_{l,4}g\cos x_{l,3}+2x_{l,5}x_{l,6}z_{l,1}+x_{l,r}^2 z_{l,2}$$

$$z_{l,5}=\phi_5(\underline{x}_l)=x_{l,5}$$

$$z_{l,6}=\phi_6(\underline{x}_l)=x_{l,6} \tag{2.20}$$

Figure 12:
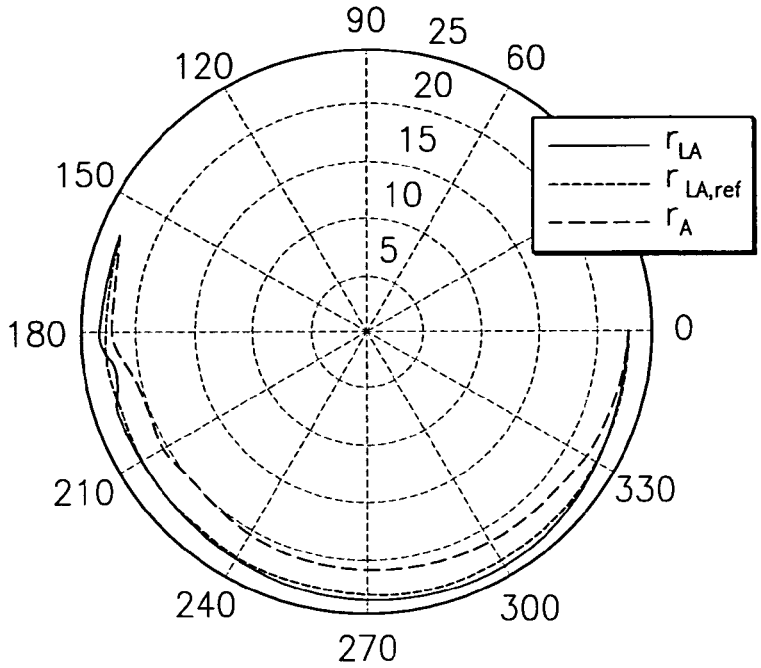
FIG. 12 shows the payload and boom positions during a rotation controlled by the second embodiment.

This transformation shows that the higher order derivatives of the radial load position $\ddot{y}_l=\ddot{r}_{L\alpha}$ and $\dddot{y}_l^*=\dddot{r}_{La}$ can be calculated from the input state $\underline{x}_l$. With this transformation applied to the system the internal dynamics results to $$\dot{z}_{l,5}=z_{l,6}$$

$$\dot{z}_{l,6}=w^* \tag{2.21}$$

which is exactly the transformed disturbance model. In our case the internal dynamics consists of a double integrator chain. This means, the internal dynamics is instable. Hence it is impossible to solve the internal dynamics by on-line simulation. But for the here given application case not only the disturbance $\dddot{\varphi}_{LD}=w^*$ but also the new states $x_{l,6}=\ddot{\phi}_D$ and $x_{l,5}=\dot{\phi}_D$ can be directly measured. This makes the simulation of the internal dynamics unnecessary 2.3 Measurement Results In this section measurement results of the obtained nonlinear controller, which was applied to the broom crane, are presented. FIG. 12 shows a polar plot of a single crane rotation. The rope length during crane operation is 35 m. The challenge is to obtain a constant payload radius $r_{LA}$ during the slewing movement.

Figure 13:
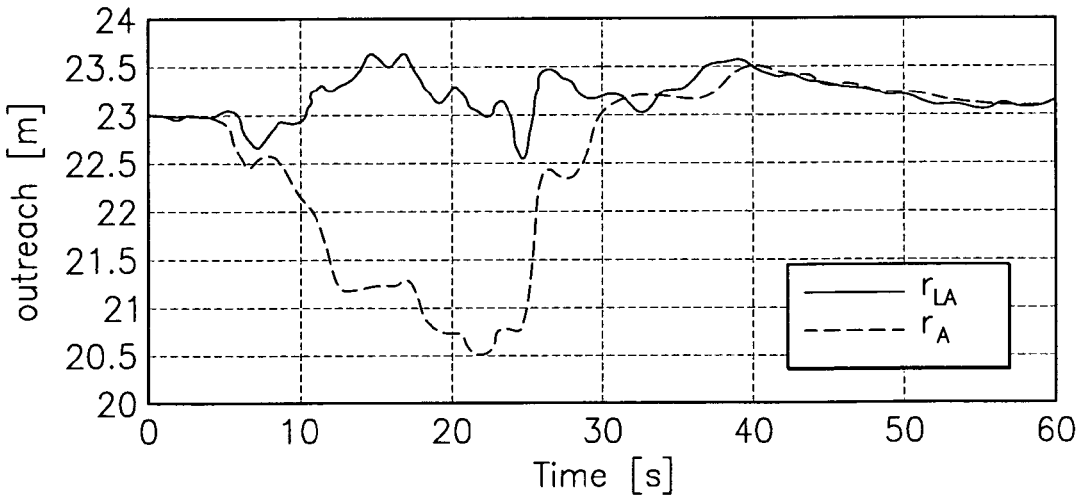
FIG. 13 shows the outreach of the payload and the boom during this rotation.

To achieve this aim a luffing movement of the boom has to compensate the centrifugal effect on the payload. This can be seen in FIG. 13 which displays the radial position of the load and the end of the boom over time. It can be seen from FIG. 12 that the payload tracks the reference trajectory with an error smaller than 0.7 m.

Figure 14:
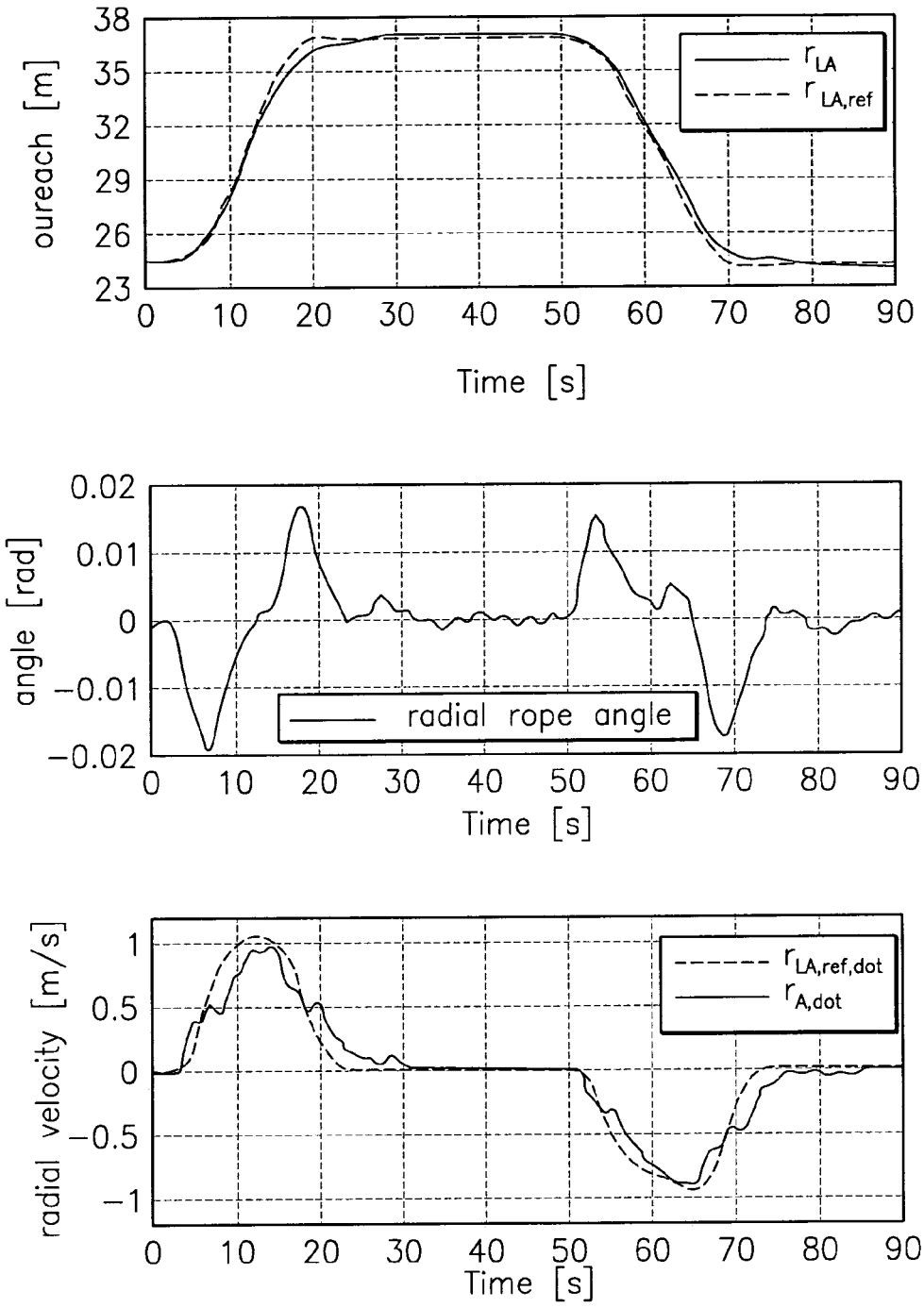
FIG. 14 shows the outreach, the radial rope angle and the radial velocities during a luffing movement controlled by the second embodiment.

The second maneuver is a luffing movement. FIG. 14 shows the payload tracking a reference position, the resulting radial rope angle during this movement and the velocity of the boom compared with the reference velocity for the payload. It can be seen that the compensating movements during acceleration and deceleration reduce the load sway in radial direction.

Figure 15:
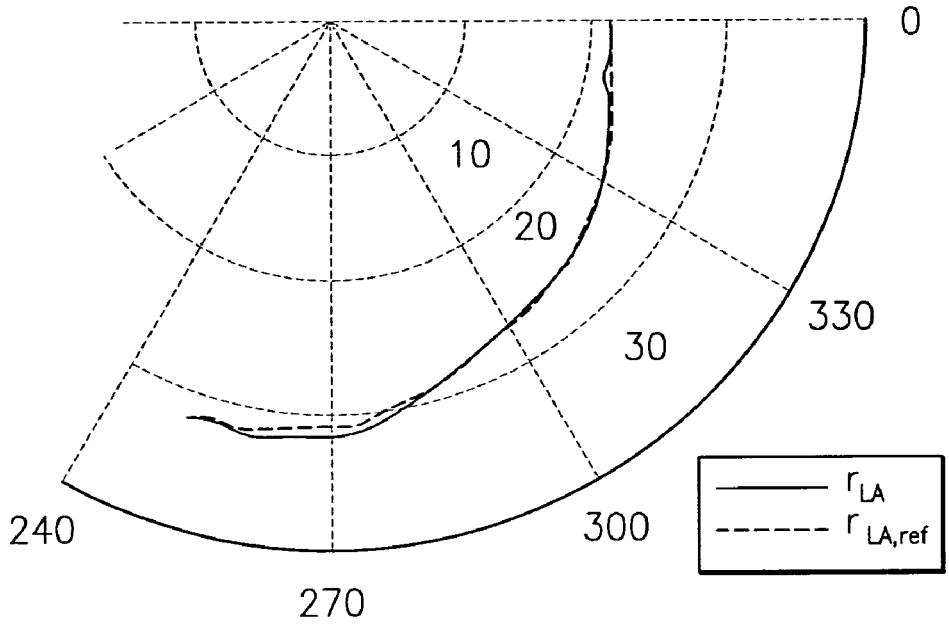
FIG. 15 shows the payload position during a combined motion controlled by the second embodiment.
Figure 16:
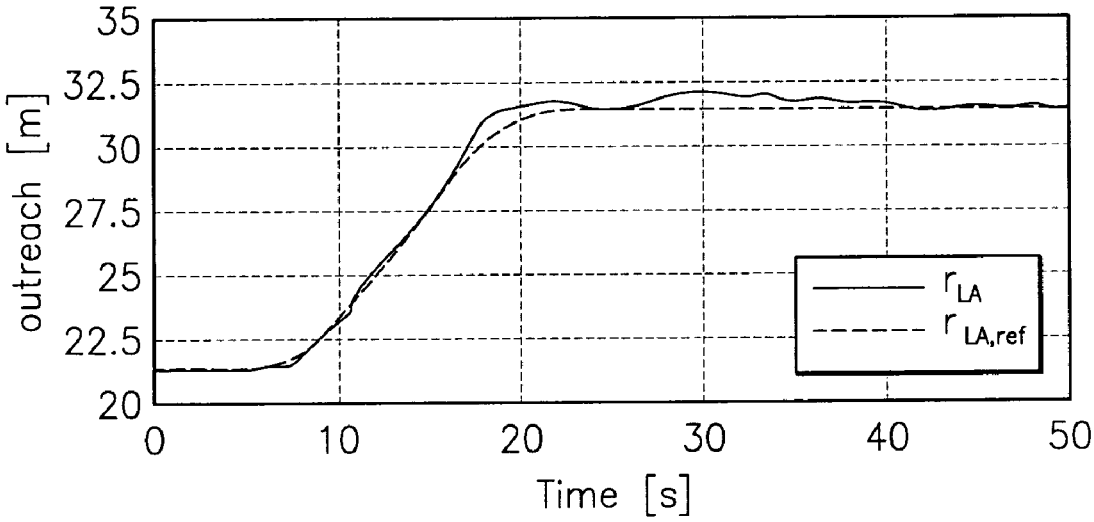
FIG. 16 shows the outreach of the payload during the combined motion.

The next maneuver is a combined maneuver containing a slewing and luffing motion of the crane. This is the most important case at transshipment processes in harbours mainly because of obstacles in the workspace of the crane. FIG. 15 shows a polar plot where the payloads radius gets increased by 10 m while rotating the crane. FIG. 16 displays the same results but over time in order to illustrate, that the radial position of the load follows the reference.

Comparing these results with that of the luffing motion it can be seen that the achieved tracking performance remains equal. Because of the disturbance decoupling it is possible to achieve a very low residual sway and good target position accuracy for luffing and stewing movements as well as for combined maneuvers.

3. Third Embodiment

The third embodiment of the present invention relates to a control structure for the slewing motion of the crane, i.e. the rotation of the tower around its vertical axis. Again, a nonlinear model for this motion is established. The inverted model is then used for controlling the actuator of the rotation of the tower, usually a hydraulic motor.

3.1 Nonlinear Model

The first part of the model describes the dynamics of the actuator for the slewing motion approximated by a first order delay term as $$\ddot{\varphi}_D+\frac{1}{T_D}\dot{\varphi}_D=\frac{2\pi K_{VD}}{\underbrace{i_D V_{MotD} T_D}_{a}}u_s, \tag{3.1}$$

wherein $\phi_D$ is the rotational angle of the tower, $T_D$ the time constant of the actuator, $u_s$ the input voltage of the servo valve, $K_{VD}$ the proportionality constant between the input voltage and the cross section of the valve, $i_D$ the transmission ratio and $V_{MotD}$ the intake volume of the hydraulic drive.

The second part is a differential equation describing the sway of the load $\phi_{St}$ in the tangential direction, which can be derived by using the method of Newton/Euler $$l_S\ddot{\varphi}_{St} + g\sin(\varphi_{St}) = -\ddot{r}_A\varphi_D\cos(\varphi_{St}) - 2\dot{r}_A\dot{\varphi}_D\cos(\varphi_{St}) + \ldots \frac{r_A\dot{\varphi}_D}{T_D}\cos(\varphi_{St}) - ar_A\cos(\varphi_{St})u_s, \tag{3.2}$$

wherein $l_S$ is the length of the rope, $r_A$ the position of the boom head in the radial direction and g the gravity constant.

By neglecting the time derivatives of the radial position of the boom head $r_A$ and linearizing the right hand side of equation (3.2) for small tangential rope angles $\phi_{St}$ of the load, the nonlinear model gets the form $$\dot{\underline{x}}_s = \underline{f}_s(\underline{x}_s) + \underline{g}_s(\underline{x}_s)u_s \tag{3.3}$$

$$\frac{d}{dt}\begin{bmatrix} x_{s,1} = \varphi_D \\ x_{s,2} = \dot{\varphi}_D \\ x_{s,3} = \varphi_{St} \\ x_{s,4} = \dot{\varphi}_{St} \end{bmatrix} = \begin{bmatrix} x_{s,2} \\ -\frac{x_{s,2}}{T_D} \\ x_{s,4} \\ \frac{r_A x_{s,2}}{l_S T_D} - \frac{g\sin(x_{s,3})}{l_S} \end{bmatrix} + \begin{bmatrix} 0 \\ a \\ 0 \\ -\frac{r_A a}{l_S} \end{bmatrix} u_s$$

Therein, the rotational angle of the tower and its time derivatives are given by $\phi_D$, $\dot{\phi}_D$, $\ddot{\phi}_D$, and the tangential rope angle and the tangential rope angle acceleration by $\phi_{St}$, $\ddot{\phi}_{St}$.

The output of the system is the rotational angle $\phi_{LD}=y_s$ of the load given by $$y_s = h_s(\underline{x}_s) = x_{s,1} + \arctan\left(\frac{\sin(x_{s,3})l_S}{r_A}\right). \tag{4.4}$$

3.2 Nonlinear Control Approach

The nonlinear system has to be checked for flatness, just as the first embodiment in equation (1.9) in chapter 1.2.1 and the second embodiment in equation (2.10) in chapter 2.2. Results show that the output $y_s$ isn't flat, as only a relative degree of r=2 is obtained.

However, a flat output $$y_s^* = h_s^*(\underline{x}_s) = \frac{r_A}{l_S}x_{s,1} + x_{s,3} \tag{3.5}$$

can be found for the nonlinear system, thereby obtaining a relative degree of r=4.

The control law is derived by Input/output-Linearization $$u_{s,lin} = \frac{-L_{\underline{f}_s}^r h_s^*(\underline{x}_s) + v_s}{L_{\underline{g}_s} L_{\underline{f}_s}^{-1} h_s^*(\underline{x}_s)}; \tag{3.6}$$

$v_s$ … neuer Eingang

-continued $$= -\frac{\sin(x_{s,3})x_{s,4}^2 l_S T_D - \cos(x_{s,3})x_{s,2}r_A + \cos(x_{s,3})\sin(x_{s,3})gT_D}{T_D\cos(x_{s,3})r_A a} + \frac{v_s l_S^2}{\cos(x_{s,3})gr_A a}$$

wherein the new input v is equal to the reference value for the forth derivative of the flat output $\ddddot{y}_{s,ref}^*$.

Further, the linearized system is stabilized by the control law $$u_{s,Stab} = \frac{\sum_{i=0}^{r_S-1} k_{s,i}\left[\overset{(i)}{y}_s^* - \overset{(i)}{y}_{s,ref}^*\right]}{L_{\underline{g}_s} L_{\underline{f}_s}^{r-1} h_s^*(\underline{x}_s)}. \tag{3.7}$$

The output value $y_s$* and its time derivatives $y_S^{(i)}$* (i=1−3) can again be calculated directly from the state vector $\underline{x}_s$ by the following transformation $$\begin{aligned} z_{s,1} &= y_s^* = \frac{r_A}{l_S}x_{s,1} + x_{s,3} \\ z_{s,2} &= \dot{y}_s^* = \frac{r_A}{l_S}x_{s,2} + x_{s,4} \\ z_{s,3} &= \ddot{y}_s^* = -\frac{g\sin(x_{s,3})}{l_S} \\ z_{s,4} &= \dddot{y}_s^* = -\frac{g\cos(x_{s,3})x_{s,4}}{l_S} \end{aligned} \tag{3.8}$$

The resulting input voltage $u_s$ for the servo valve is given by $$u_s = u_{s,Lin} - u_{s,Stab} \tag{3.9}$$

To use the reference trajectories as a reference for the control system, the reference values $\underline{y}_{s,ref}$ generated by the trajectory planner for the real output have to be transformed into reference values $\underline{y}_{s,ref}$* for the flat output. For this output transformation the relation between the real output $$y_s = h_s(\underline{x}_s) = x_{s,1} + \arctan\left(\frac{\sin(x_{s,3})l_S}{r_A}\right)$$

from equation (3.4) and the flat, linearized output $$y_s^* = h_s^*(\underline{x}_s) = \frac{r_A}{l_S}x_{s,1} + x_{s,3}$$

from equation (3.5) has to be determined. However, the output $y_{s,lin}$ linearized around the zero position of the rope angle differs very little from the non-simplified value in the working range of the crane, such that the difference can be neglected and $y_{x,lin}$ can be used for deriving the output transformation. Linearizing equation (3.4) around $x_{s,3}$=0 gives:

$$y_{s,lin} = x_{s,1} + \frac{l_S}{r_A}x_{s,3} \tag{3.10}$$

such that $$y_s^* = \frac{r_A}{l_S} y_{s,lin} \approx \frac{r_A}{l_S} y_s \tag{3.11}$$

can be used. Therefore, the output transformation results only in a multiplication of the reference trajectory $\underline{y}_{s,ref}$ with the factor $$\frac{r_A}{l_S}.$$

Figure 17:
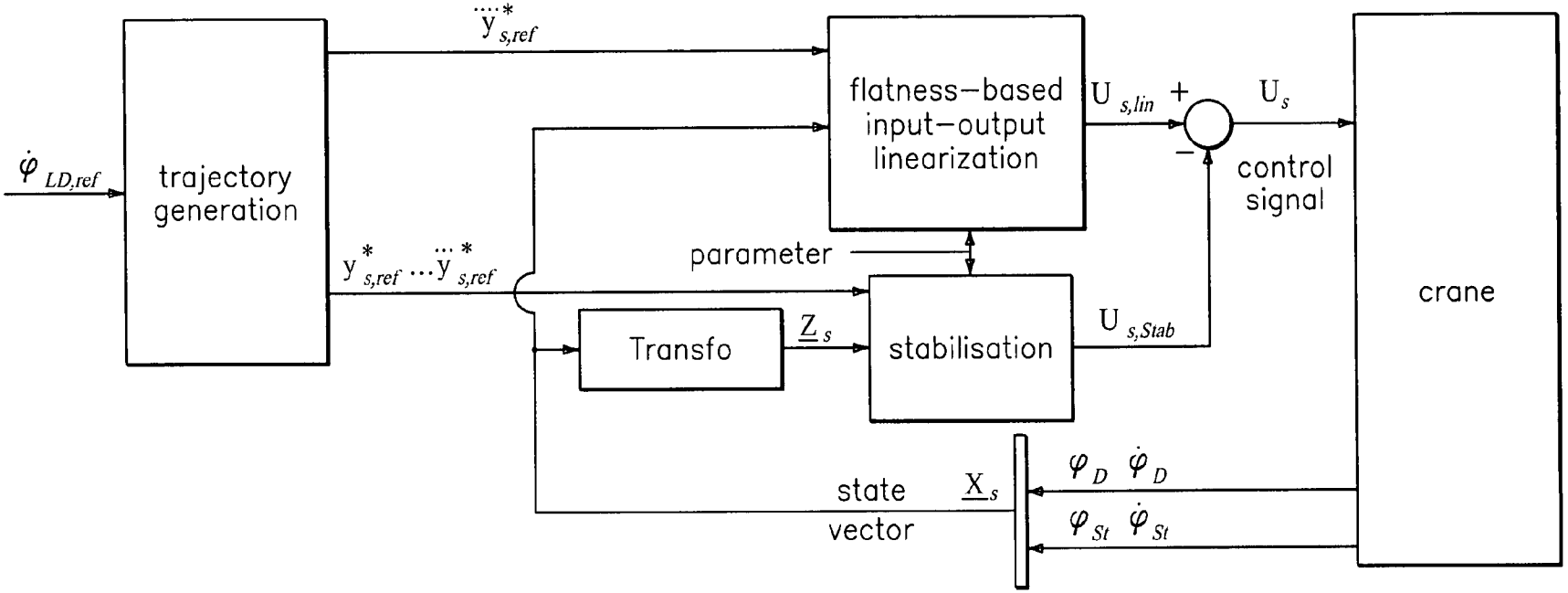
FIG. 17 shows a third embodiment of a control structure according to the present invention.

The resulting control structure for the slewing motion of the crane can be seen from FIG. 17.

Of course, a control structure of the present invention can also be a combination of either the first or the second embodiment with the third embodiment, such that sway both in the radial and the tangential direction is suppressed by the control structure.

The best results will be produced by a combination of the second and the third embodiment, wherein sway produced by the luffing movement of the boom itself and by the acceleration of the load in the radial direction due to the slewing motion of the crane is taken into account for the anti-sway control for the luffing movement of the second embodiment, and sway in the tangential direction due to the slewing motion is avoided by the control structure of the third embodiment.

However, especially the second embodiment will also produce a very good anti-sway control on its own, such that the stewing motion could also be controlled directly by the crane driver without using the third embodiment.

Additionally, all the three embodiments will provide precise control of the load trajectory by using inverted non-linear models stabilized by a control loop even when used on their own.

The invention claimed is:

1. A control system for a boom crane, the boom crane having a tower and a boom pivotally attached to the tower, the control system comprising:

a first actuator for creating a luffing movement of the boom, the boom including a boom head, a second actuator for rotating the tower, a first detector for determining a position and velocity of the boom head by measurement, a second detector for determining a rotational angle and rotational velocity of the tower by measurement, the control system controlling the first actuator and the second actuator, wherein an acceleration of a load connected to the boom in a radial direction due to a rotation of the tower is compensated by a luffing movement of the boom in dependence on the rotational velocity.

2. A control system according to claim 1, having a first control unit for controlling the first actuator and a second control unit for controlling the second actuator.

3. A control system according to claim 2, wherein the first control unit avoids sway of the load in the radial direction due to the luffing movements of the boom and the rotation of the tower.

4. A control system according to claim 2, wherein the second control unit avoids sway of the load in the tangential direction due to the rotation of the tower.

5. A control system according to claim 2, wherein the first or the second control unit are based on the inversion of non-linear systems describing the respective crane movements in relation to the sway of the load.

6. A control system according to claim 1, wherein the crane additionally has a third detector for determining the radial rope angle or velocity or the tangential rope angle or velocity-by measurement.

7. A control system according to claim 6, wherein the control of the first actuator by the first control unit is based on the rotational velocity of the tower determined by the second detector.

8. A control system according to claim 6, wherein higher order derivatives of the radial load position are calculated from the radial rope angle and velocity determined by the third detector and the position and velocity of the boom head determined by the first detector.

9. A control system according to claim 6, wherein higher order derivatives of the rotational load angle are calculated from the tangential rope angle and velocity determined by the third detector and the rotational angle and the rotational velocity of the tower determined by the second detector.

10. A control system according to claim 1, wherein the second detector additionally determine the second or third derivative of the rotational angle of the tower.

11. A control system according to claim 10, wherein the second or third derivative of the rotational angle of the tower is used for the compensation of the sway of the load in the radial direction due to a rotation of the tower.

12. A control system according to claim 1, wherein the control system is based on the inversion of a model describing the movements of the load suspended on a rope in dependence on the movements of the crane.

13. A control system according to claim 12, wherein the model is non-linear.

14. A control system according to claim 13, wherein the non-linear model is linearized either by exact linearization or by input/output linearization.

15. A control system according to claim 14, wherein the non-linear model is simplified to make linearization possible.

16. A control system according to claim 15, wherein the internal dynamics of the model due to the simplification are stable or measurable.

17. A control system according to claim 13, wherein the nonlinear model describes the radial movement of the load.

18. A control system according to claim 12, wherein the control is stabilized using a feedback control loop.

19. A control system according to claim 12, wherein the sway of the load is compensated by counter-movements of the first and/or the second actuator.

20. A control system according to claim 19, wherein the counter-movements occur mostly at the beginning and the end of a main movement.

21. A control system according to claim 12, wherein a centrifugal acceleration of the load due to the rotation of the crane is taken into account.

22. A control system according to claim 21, wherein the centrifugal acceleration is treated as a disturbance.

23. A control system according to claim 12, wherein the control system uses the inverted model to control the first and second actuators in order to keep the load on a predetermined trajectory.

24. A control system according to claim 23, wherein the predetermined trajectories of the load are provided by a trajectory generator.

25. A control system according to claim 12, wherein the model takes into account the non-linearities due to the kinematics of the first actuator and/or the dynamics of the first actuator.

26. A control system according to claim 12, wherein the model is a non-linear model of the load suspended on the rope and the crane including the first actuator.

27. A boom crane comprising:

a tower;

a boom pivotally attached to the tower, the boom including a boom head; and a control system, the control system comprising:

a first actuator for creating a luffing movement of the boom, a second actuator for rotating the tower, a first detector for determining a position and velocity of the boom head by measurement, a second detector for determining a rotational angle and rotational velocity of the tower by measurement, the control system controlling the first actuator and the second actuator, wherein an acceleration of a load connected to the boom in a radial direction due to a rotation of the tower is compensated by a luffing movement of the boom in dependence on the rotational velocity.

* * * * *